US009987851B2

(12) United States Patent
Kanbara et al.

(10) Patent No.: US 9,987,851 B2
(45) Date of Patent: Jun. 5, 2018

(54) INK SUPPLY UNIT AND INKJET PRINTING APPARATUS

(71) Applicant: MIMAKI ENGINEERING CO., LTD., Nagano (JP)

(72) Inventors: Takaaki Kanbara, Nagano (JP); Toru Nakamura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/102,523

(22) PCT Filed: Dec. 12, 2014

(86) PCT No.: PCT/JP2014/082962
§ 371 (c)(1),
(2) Date: Jun. 7, 2016

(87) PCT Pub. No.: WO2015/088001
PCT Pub. Date: Jun. 18, 2015

(65) Prior Publication Data

US 2016/0355021 A1 Dec. 8, 2016

(30) Foreign Application Priority Data

Dec. 13, 2013 (JP) ..... 2013-258328
Dec. 13, 2013 (JP) ..... 2013-258527

(51) Int. Cl.
*B41J 2/175* (2006.01)
*B41J 29/13* (2006.01)

(52) U.S. Cl.
CPC ..... *B41J 2/17553* (2013.01); *B41J 2/175* (2013.01); *B41J 2/1752* (2013.01);
(Continued)

(58) Field of Classification Search
CPC .... B41J 2/17553; B41J 29/13; B41J 2/17523; B41J 2/17509; B41J 2/17506; B41J 2/1752; B41J 2/175; F25D 23/126; B05B 11/3056
See application file for complete search history.

(56) References Cited

U.S. PATENT DOCUMENTS 7,431,437 B2 * 10/2008 Wilson, II ..... B41J 2/17506 347/85
2005/0151803 A1 7/2005 Wilson, II et al.

FOREIGN PATENT DOCUMENTS

EP 2617572 7/2013
JP H10157154 6/1998

OTHER PUBLICATIONS

"International Search Report (Form PCT/ISA/210)", dated Feb. 24, 2015, with English translation thereof, pp. 1-4.
(Continued)

*Primary Examiner* — Geoffrey Mruk
(74) *Attorney, Agent, or Firm* — JCIPRNET

(57) ABSTRACT

An ink supply unit is provided and includes an ink container, and a cap fittable to the ink container and having an opening, a valve body, and an elastic body, an ink tank that holds the ink container fitted with the cap at a cap-side part of the container, a pivotable lever disposed on the ink tank pivotably around a pivot axis that is a pivoting center; an anti-rotation mechanism configured to restrict relative rotations of the ink container and of the cap to the ink tank, a conversion mechanism configured to convert the pivoting motion of the pivotable lever into linear motions of the ink container and of the cap in a direction along the pivot axis, and a valve-opening projection that presses the valve body toward an opening position when the cap is drawn nearer to the ink tank by the linear motion of the cap.

6 Claims, 16 Drawing Sheets

(52) U.S. Cl.
CPC ..... *B41J 2/17506* (2013.01); *B41J 2/17509* (2013.01); *B41J 2/17523* (2013.01); *B41J 29/13* (2013.01)

(56) References Cited

OTHER PUBLICATIONS

"Office Action of Japan Counterpart Application," with English translation thereof, dated May 16, 2017, p. 1-p. 7.
"Search Report of Europe Counterpart Application", dated Dec. 19, 2017, p. 1-p. 9, in which the listed references were cited.

* cited by examiner

INK SUPPLY UNIT AND INKJET PRINTING APPARATUS

TECHNICAL FIELD

The present invention relates to an ink supply unit and an inkjet printing apparatus.

BACKGROUND ART

In regard to the conventional ink supply units and inkjet printing apparatuses, Patent Literature 1 discloses an ink supply device for inkjet printers characterized by the following technical features; ink tanks containing different color inks are located distantly from color ink nozzle units, ink buffers disposed in the color ink nozzle units are connected to the ink tanks with ink supply tubes and ink replenishment tubes, the ink supply tubes each have an energizing means, and the ink replenishment tubes each have a tube opening/closing means. This ink supply device is operable to select any one of initial ink supply to the color ink nozzle units, deairing, and ink replenishment during priming and printing by choosing to activate or deactivate the energizing means, and choosing to open or close the tube opening/closing means. The ink tanks of this ink supply device containing different color inks each have an upper part configured to have an ink cassette be attachable and detachable to and from the upper part via a liquid level conserving means.

CITATION LIST

Patent Literature

Patent Literature 1: JP H10-157154 A

SUMMARY

Technical Problems

The ink supply device described in aforementioned Patent Literature 1 may need further improvements in workability, for example, at the time of replenishing the ink tanks with inks:

The ink supply device described in aforementioned Patent Literature 1 may also need further improvements in versatility, for example, to be usable with a broader range of printers.

Faced with such needs, the present invention provides an ink supply unit that may be improved in workability of ink replenishment, and an inkjet printing apparatus.

To meet the needs, the present invention further provides an inkjet printing apparatus that may be improved in versatility.

Solutions to Problems

To this end, an ink supply unit according to the present invention includes: an ink container for storage of an ink; a cap fittable to the ink container, the cap having an opening that allows the ink stored in the ink container to flow out therethrough, a valve body that allows the opening to open and close, and an elastic body that biases the valve body from an inner side of the ink container toward a closing position; an ink tank structured to hold the ink container fitted with the cap at a cap-side part of the ink container; a pivotable lever disposed on the ink tank pivotably around a pivot axis that is a pivoting center; an anti-rotation mechanism configured to restrict relative rotations of the ink container and of the cap to the ink tank with the ink container being held in the ink tank; a conversion mechanism configured to convert the pivoting motion of the pivotable lever into linear motions of the ink container and of the cap in a direction along the pivot axis; and a valve-opening projection disposed inside of the ink tank, the valve-opening projection serving to press the valve body toward an opening position when the cap is drawn nearer to the ink tank by the linear motions of the ink container and of the cap.

In the ink supply unit, the pivotable lever is pivoted, with the rotations of the ink container and of the cap being restricted by the anti-rotation mechanism, and the pivoting motion of the pivotable lever is converted by the conversion mechanism into linear motions of the ink container and of the cap. Then, the cap is drawn nearer to the ink tank by the linear motions to have the valve body of the cap be opened by the valve-opening projection. Resultantly, the ink tank may be replenished with the ink from the ink container. Further advantageously, the ink supply unit, by pivoting the pivotable lever in a direction reverse to the before-mentioned direction, moves the ink container and the cap away from the ink tank to close the valve body of the cap. Resultantly, the ink replenishment into the ink tank may be stopped. This ink supply unit thus structured and operated may successfully improve workability of ink replenishment into the ink tank.

The ink supply unit may be further characterized in that the pivotable lever has a cylindrical shape and is pivotably supported by the ink tank, the pivotable lever having a cylindrical portion formed in a cylindrical shape and having the cap be inserted therein, and a lever portion radially projecting from the cylindrical portion, the conversion mechanism has a guiding projection radially projecting from the cap, and a guiding recess formed in a wall surface of the cylindrical portion, the guiding recess being inclined relative to the direction along the pivot axis and having the guiding projection be inserted therein, and the guiding recess guides the guiding projection in the direction along the pivot axis in conjunction with relative rotations of the pivotable lever and of the cap.

In the ink supply unit, with the guiding projection being inserted in the guiding recess, relative rotations of the pivotable lever and of the cap allow the guiding recess to guide the guiding projection in the direction along the pivot axis. Then, the conversion mechanism can convert the pivoting motion of the pivotable lever into linear motions of the ink container and of the cap in the direction along the pivot axis.

The ink supply unit may be further characterized in that the anti-rotation mechanism has an anti-rotation projection radially projecting from the ink container or the cap formed in a cylindrical shape; and an anti-rotation engaging portion formed in the ink tank and engageable with the anti-rotation projection.

With the ink container being held in the ink tank, the anti-rotation engaging portion is engaged with the anti-rotation projection. The anti-rotation mechanism is thereby allowed to restrict relative rotations of the ink container and of the cap to the ink tank around the pivot axis.

The ink supply unit may further include: an open-to-atmosphere tube that communicates inside of the ink tank with the atmosphere, with the ink container being held in the ink tank; and an open-to-atmosphere projection disposed on the pivotable lever and movable to and from a releasing position and a constricting position, the releasing position and the constricting position respectively being positions at which the open-to-atmosphere tube is released and the open-to-atmosphere tube is pressed to be constricted in conjunction with the pivoting motion of the pivotable lever, wherein the open-to-atmosphere projection is located at the releasing position when the valve body is at the opening position, and the open-to-atmosphere projection is located at the constricting position when the valve body is at the closing position.

In the ink supply unit thus characterized, the open-to-atmosphere projection allows the open-to-atmosphere tube to be constricted or released in conjunction with the pivoting motion of the pivotable lever. This ink supply unit thus structured may have the advantages; adequate replenishment of the ink by opening the ink tank to the atmosphere, and prevention of outflow of the ink left in the open-to-atmosphere tube into the ink tank at the time of removal of the ink container.

To serve the purpose described earlier, an inkjet printing apparatus according to the present invention includes: an ink container for storage of an ink; and an inkjet head connectable via a connector to an ink supply port of the ink container to be supplied with the ink from the ink container, the connector including: a rotary member disposed on one end side of an ink supply system having the inkjet head installed on the other end side thereof, the rotary member being independently rotatable and having a recess formed in the ink supply port and engaging a projection, or a projection formed in the ink supply port and engaging a recess; and a stopper operable to stop rotation of the ink container, wherein rotation of the ink container is stopped by the stopper, linear motion of the ink container is effected by relative movements of the recess and of the projection in conjunction with the rotation of the rotary member, and the ink supply port closed then is opened by the linear motion to supply the ink.

The rotation of ink container is stopped by the stopper, linear motion of the ink container is effected by relative movements of the recess and of the projection in conjunction with the rotation of the rotary member, and the closed ink supply port is opened by the linear motion of the ink container to supply and replenish the inkjet head with the ink from the ink container. The inkjet printing apparatus thus advantageous may improve workability of ink replenishment.

To achieve the purpose described earlier, an inkjet printing apparatus according to the present invention includes: a liquid storage container for storage of a liquid; and a liquid tank disposed on a vertically lower side of the liquid storage container that stores therein the liquid supplied from the liquid storage container, the liquid tank having a coupling section coupled to the liquid storage container be tightly sealed, the inkjet printing apparatus being structured to supply the inkjet head with the liquid stored in the liquid tank, wherein the liquid tank has an opening that communicates inside of the liquid tank with outside and opens toward the atmosphere, the opening has an open-to-atmosphere tube that communicates inside of the liquid tank with the atmosphere, and the open-to-atmosphere tube extends to a vertically upper side of the liquid storage container coupled to the liquid tank to prevent at least the liquid in the liquid tank from flowing out.

In case the inkjet printing apparatus has the liquid tank be replenished with a liquid from a liquid storage container with no opening communicating with outside (atmosphere), it may be useful to dispose the liquid tank on the vertically lower side of the liquid storage container to supply the liquid tank with the liquid. The inkjet printing apparatus using a liquid storage container with an opening communicating with outside (atmosphere) or a liquid-filled container, on the other hand, may be fraught with the risk described below. For example, even while the liquid tank is already filled with the liquid to its full capacity, all of the liquid of the liquid storage container may flow out into the liquid container on the vertically lower side, starting to run over the liquid tank. The inkjet printing apparatus disclosed herein, however, may prevent such overflow of the liquid by tightly sealing the coupling section of the liquid tank coupled to the liquid storage container. Once the liquid storage container becomes empty, the liquid is supplied from the liquid tank into the inkjet head. In case, however, the inkjet printing apparatus uses a liquid storage container with no opening communicating with outside (atmosphere) or a liquid-filled container, there is no air inflow into the liquid tank since the coupling section is tightly sealed, producing a negative pressure in the liquid tank. When the negative pressure goes beyond a predetermined pressure value, the liquid supply may be disabled although the liquid tank still contains the liquid. In an attempt to solve this problem, a through hole was formed in a part of the liquid tank as an opening communicating with outside. This is, however, not an effective solution with the inkjet printing apparatus using a liquid storage container with an opening communicating with outside (atmosphere) or a liquid-filled container, posing the risk of liquid overflow through the opening. The inkjet printing apparatus is, therefore, provided with the open-to-atmosphere tube in the opening, wherein the open-to-atmosphere tube extends to the vertically upper side of the ink container to prevent overflow of at least the liquid in the liquid tank. This technical solution may allow the inkjet printing apparatus to cope with various types of liquid storage containers, including containers having openings communicating with outside (atmosphere), containers with no opening communicating with outside (atmosphere), and liquid-filled containers, thus conducing to improved versatility.

The inkjet printing apparatus may be further characterized in that the inkjet head is connectable via a connector to a liquid supply port of the liquid storage container to be supplied with the liquid from the liquid storage container, the connector including: a rotary member disposed on one end side of a liquid supply system having the inkjet head installed on the other end side thereof, the rotary member being independently rotatable and having a recess formed in the liquid supply port and engaging a projection, or a projection formed in the liquid supply port and engaging a recess; and a stopper operable to stop rotation of the liquid storage container, wherein rotation of the liquid storage container is stopped by the stopper, linear motion of the liquid storage container is effected by relative movements of the recess and of the projection in conjunction of the rotation of the rotary member, and the liquid supply port closed then is opened by the linear motion to supply the liquid, the inkjet printing apparatus further including a sealing member that tightly seals a gap between the liquid supply port and a wall surface that defines a liquid storage space of the liquid tank, with the liquid storage container and the liquid supply port being coupled to the liquid tank, to tightly seal the coupling section of the liquid tank coupled to the liquid storage container.

In the inkjet printing apparatus, rotation of the ink storage container is stopped by the stopper, linear motion of the ink storage container is effected by relative movements of the recess and the projection in conjunction with the rotation of the rotary member, and the closed liquid supply port is opened by the linear motion of the ink storage container to replenish the liquid tank with the liquid from the liquid storage container and supply the inkjet head with the liquid from the liquid tank. Further advantageously, the inkjet printing apparatus may tightly seal, using the sealing member, the coupling section of the liquid tank coupled to the liquid storage container.

The inkjet printing apparatus may further include an open-to-atmosphere projection disposed on the rotary member and movable to and from a releasing position and a constricting position, the releasing position and the constricting position respectively being positions at which the open-to-atmosphere tube is released and the open-to-atmosphere tube is pressed to be constricted in conjunction with the rotation of the rotary member, wherein the open-to-atmosphere projection is located at the releasing position when the liquid supply port is open, and the open-to-atmosphere projection is located at the constricting position when the liquid supply port is closed.

In the inkjet printing apparatus thus characterized, the open-to-atmosphere tube may be constricted or released by the open-to-atmosphere projection in conjunction with the rotation of the rotary member. The inkjet printing apparatus, by way of adequate ink replenishment by opening the ink tank to the atmosphere, may properly manage residual ink of the liquid tank. Further advantageously, the liquid remaining in the open-to-atmosphere tube may be prevented from flowing out into the liquid tank at the time of removal of the liquid storage container.

Advantageous Effects of Invention

The ink supply unit and the inkjet printing apparatus according to the present invention may advantageously improve workability of replenishment of the ink into the ink tank.

The ink supply unit according to the present invention may be advantageously improved in versatility.

DESCRIPTION OF EMBODIMENTS

Embodiments according to the present invention are hereinafter described in detail referring to the accompanying drawings. It should be understood that the scope of the present invention is not restricted by the embodiments hereinafter described. Structural elements described in the embodiments may include replaceable and readily available or substantially identical components.

First Embodiment

Figure 1:
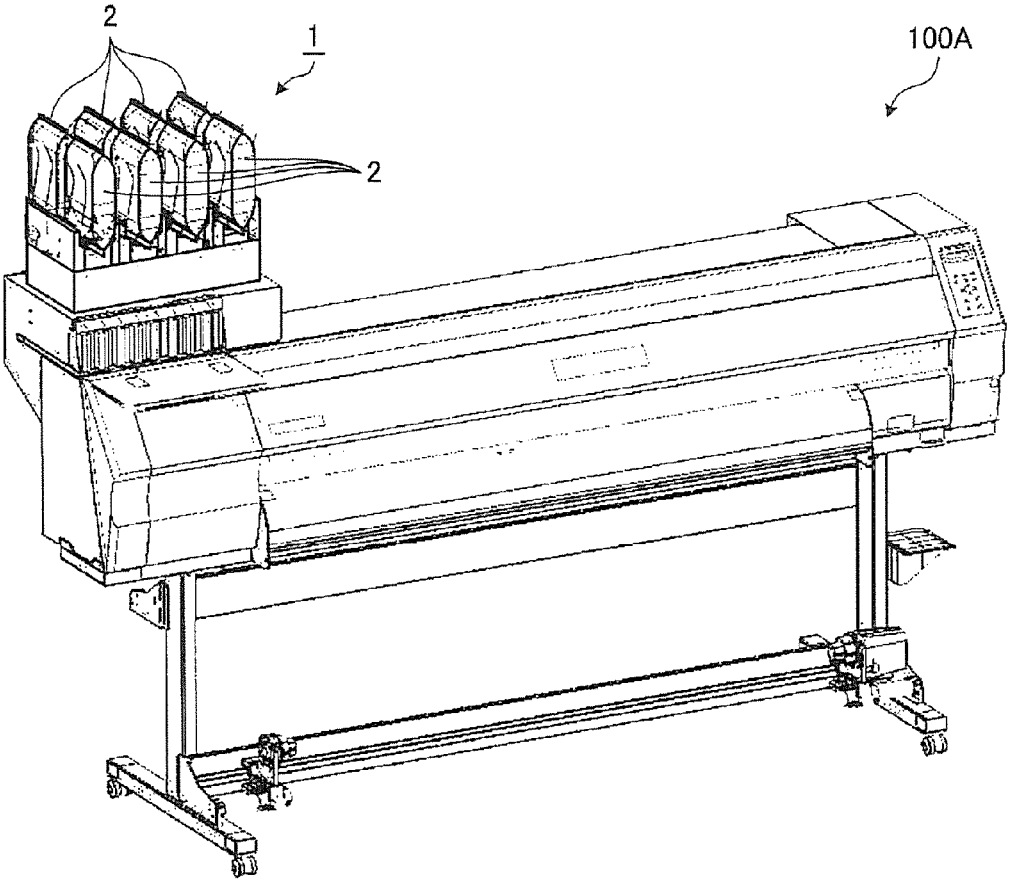
FIG. 1 is a perspective view of an exemplified inkjet printer to which an ink supply unit according embodiments is applicable.
Figure 2:
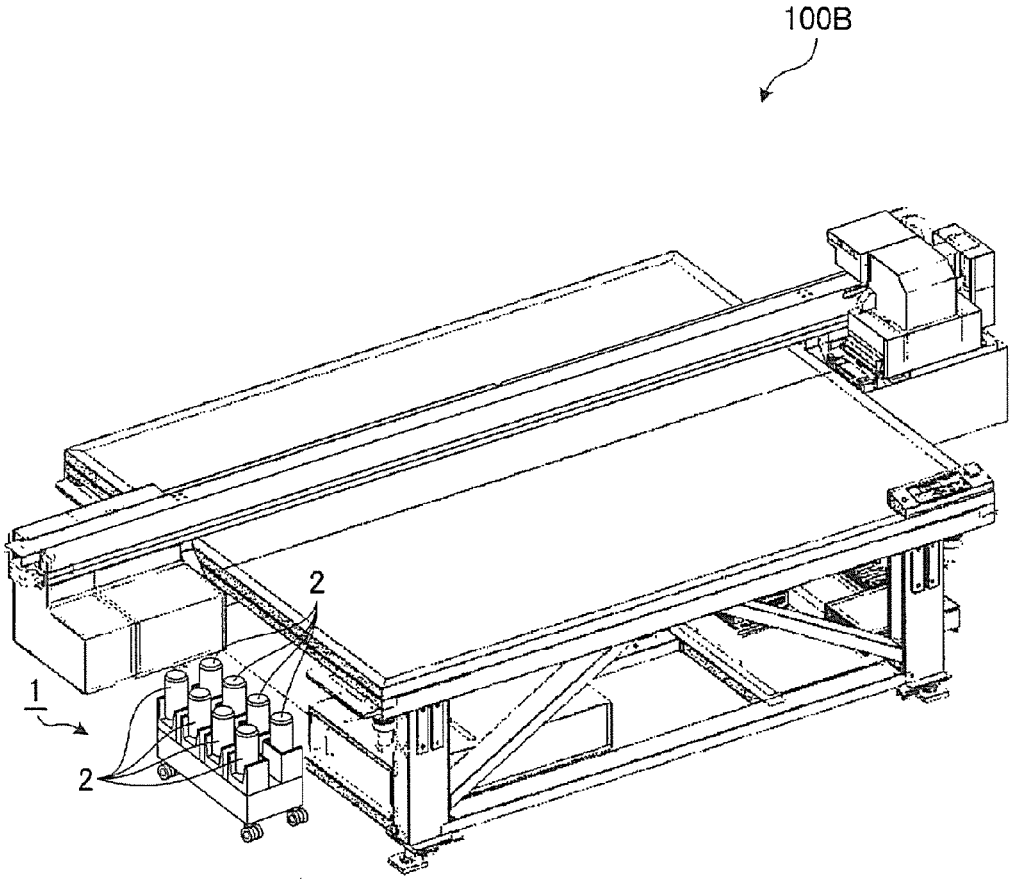
FIG. 2 is a perspective view of an exemplified inkjet printer to which the ink supply unit according to the embodiments is applicable.
Figure 3:
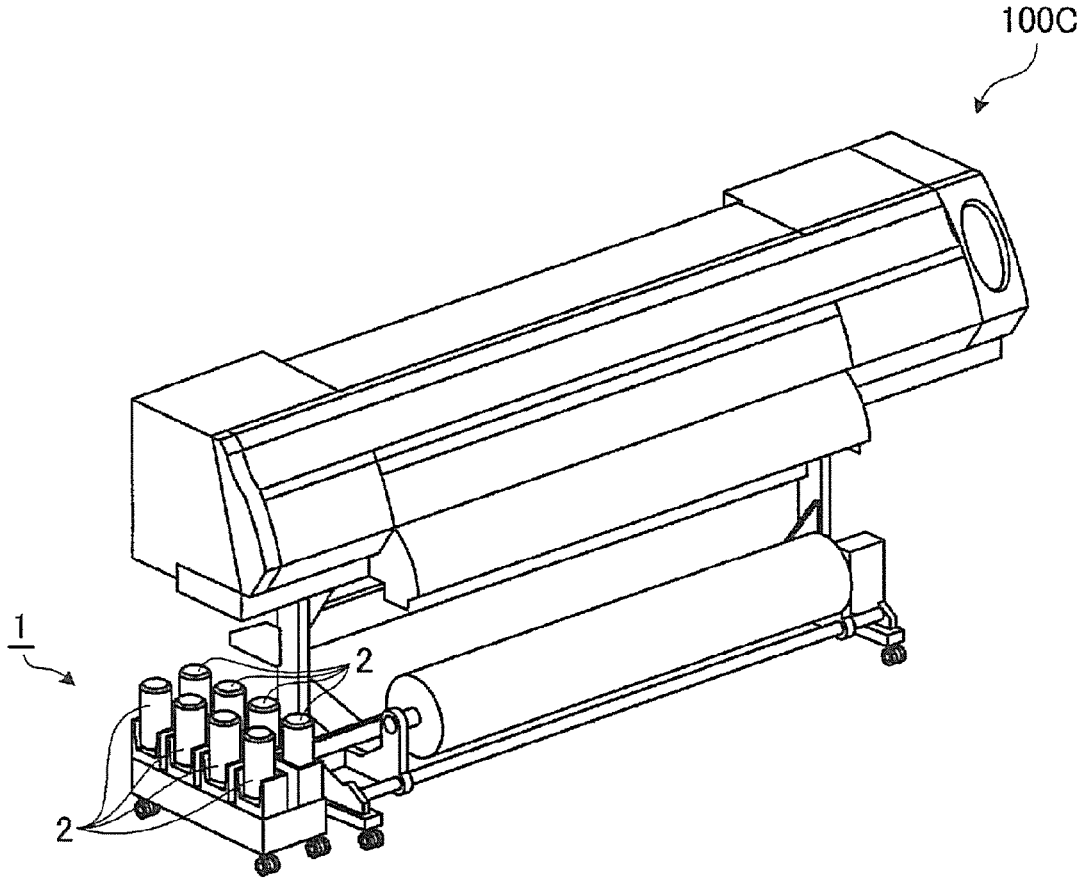
FIG. 3 is a perspective view of an exemplified inkjet printer to which the ink supply unit according to the embodiments is applicable.
Figure 4:
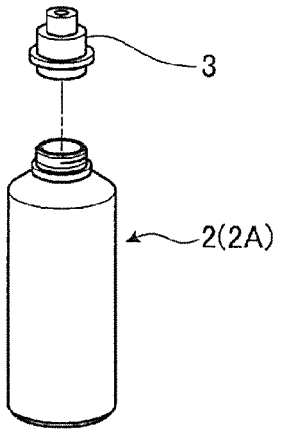
FIG. 4 is a schematic perspective view of an exemplified ink container applicable to the ink supply unit according to the embodiments.
Figure 5:
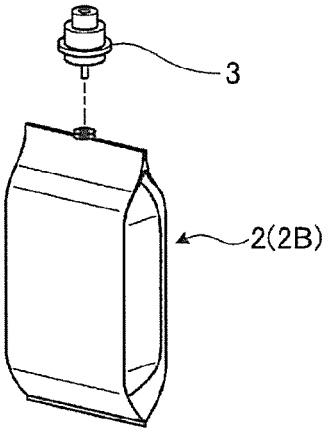
FIG. 5 is a schematic perspective view of an exemplified ink container applicable to the ink supply unit according to the embodiments.
Figure 6:
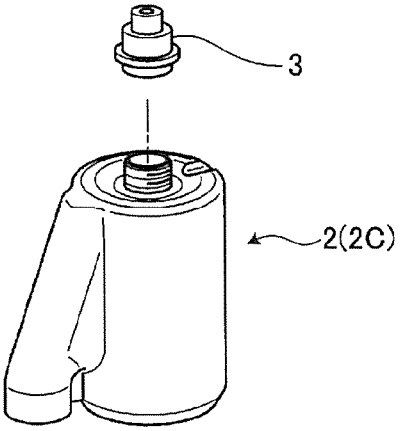
FIG. 6 is a schematic perspective view of an exemplified ink container applicable to the ink supply unit according to the embodiments.
Figure 7:
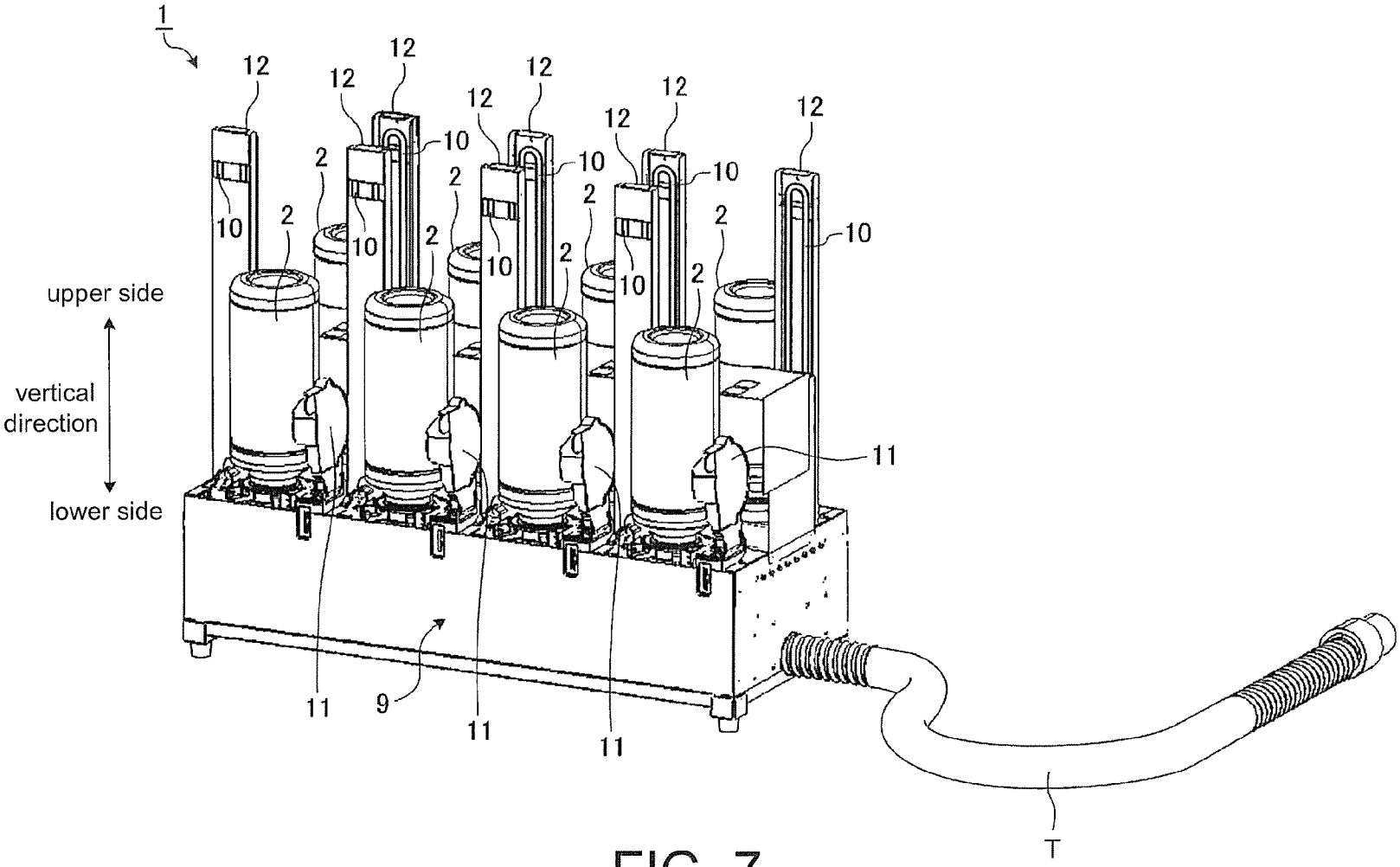
FIG. 7 is a perspective view, schematically illustrating structural features of the ink supply unit according to the embodiments.
Figure 8:
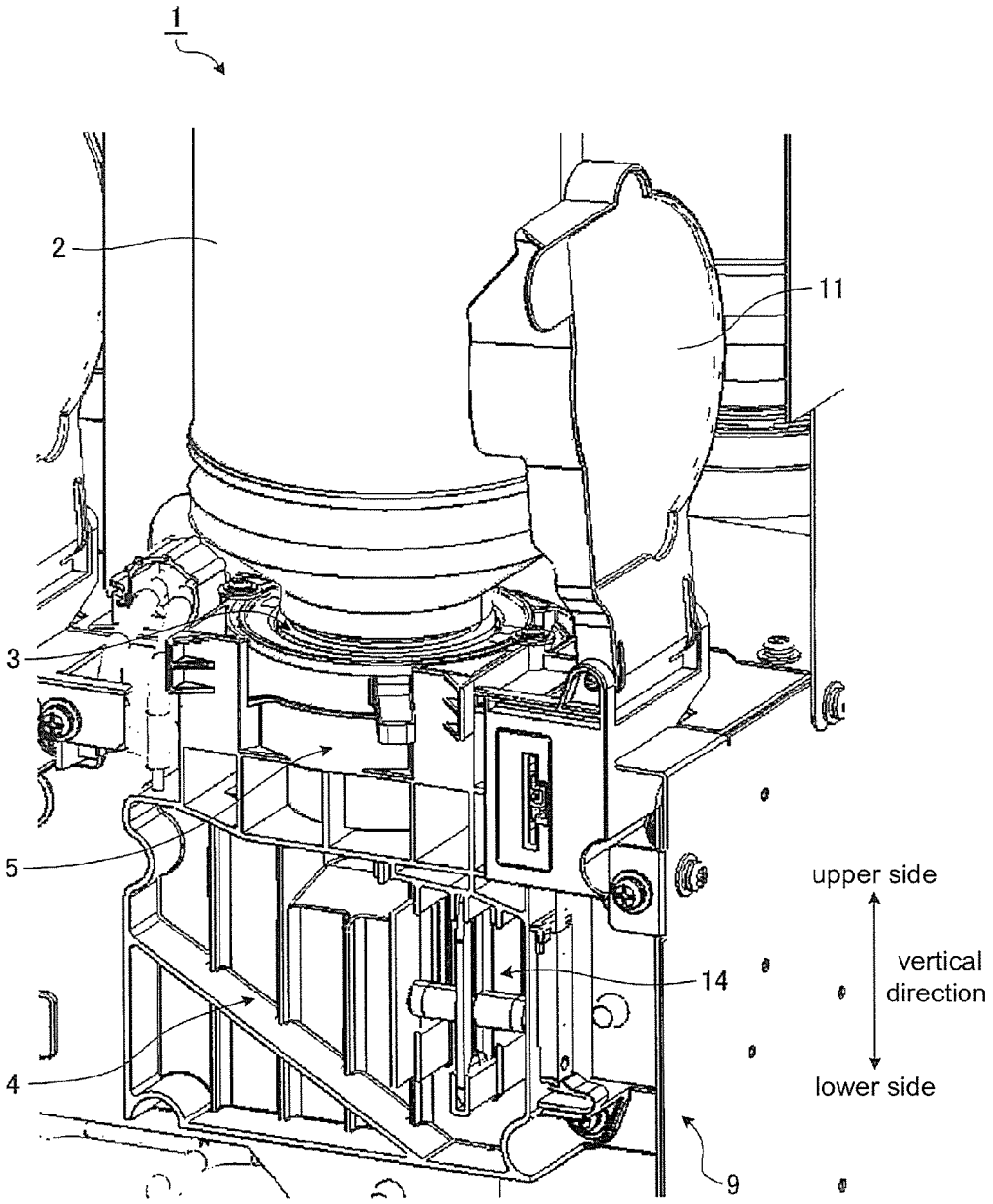
FIG. 8 is a perspective view in part of the ink supply unit according to the embodiments.
Figure 9:
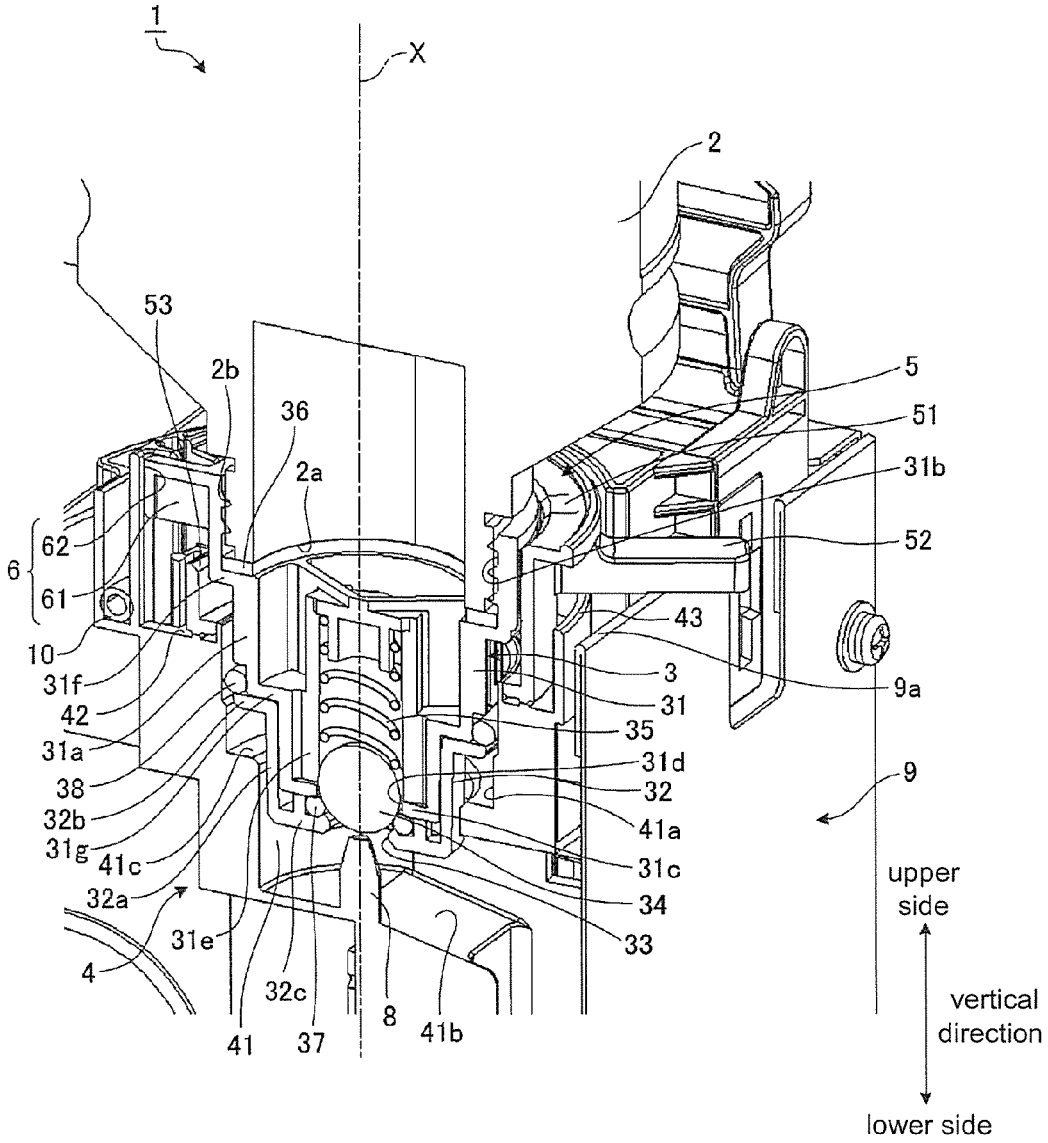
FIG. 9 is a perspective view of the ink supply unit according to the embodiments partly illustrated in cross section.
Figure 10:
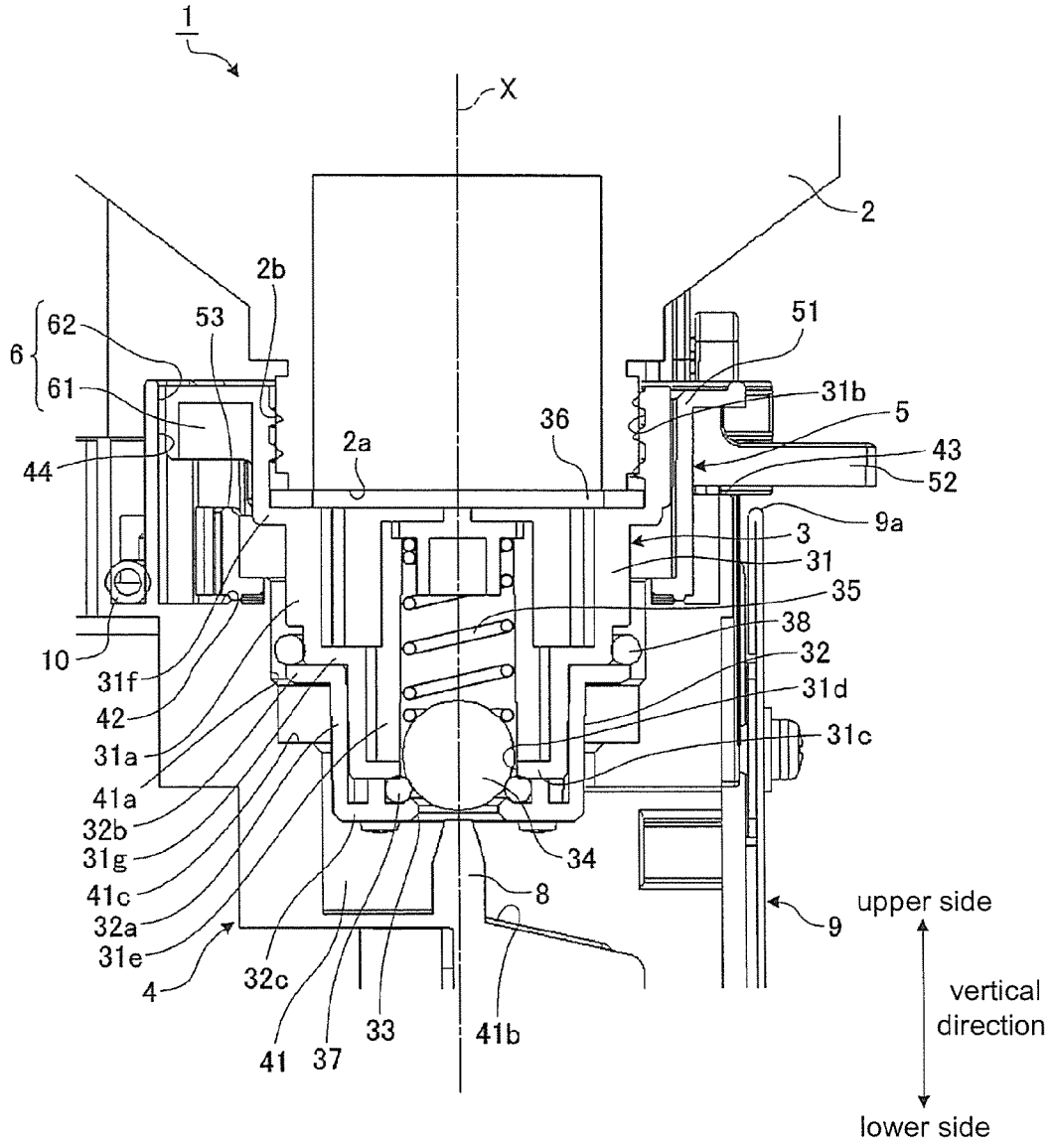
FIG. 10 is a cross-sectional view in part of the ink supply unit according to the embodiments.
Figure 11:
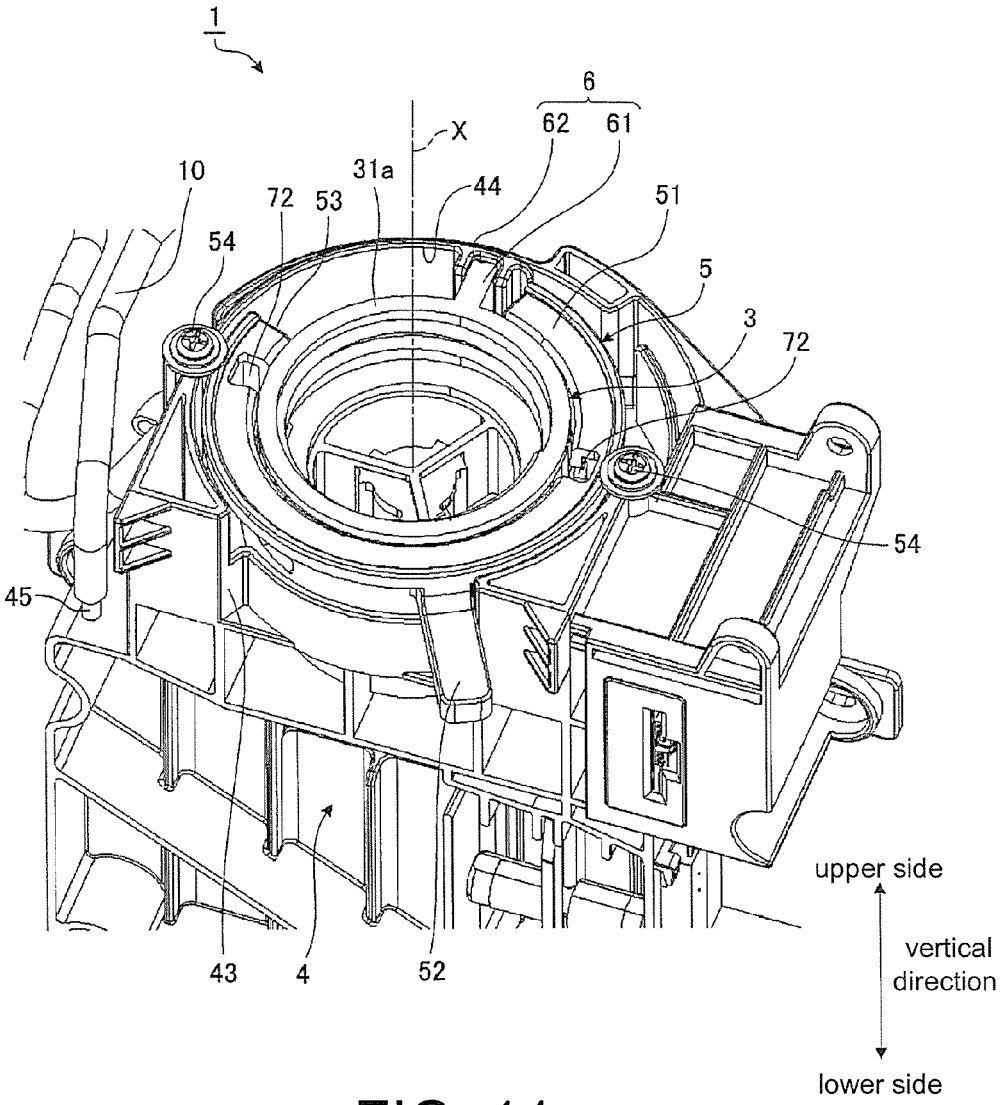
FIG. 11 is a perspective view in part of the ink supply unit according to the embodiments after the ink container is removed from the ink supply unit.
Figure 12:
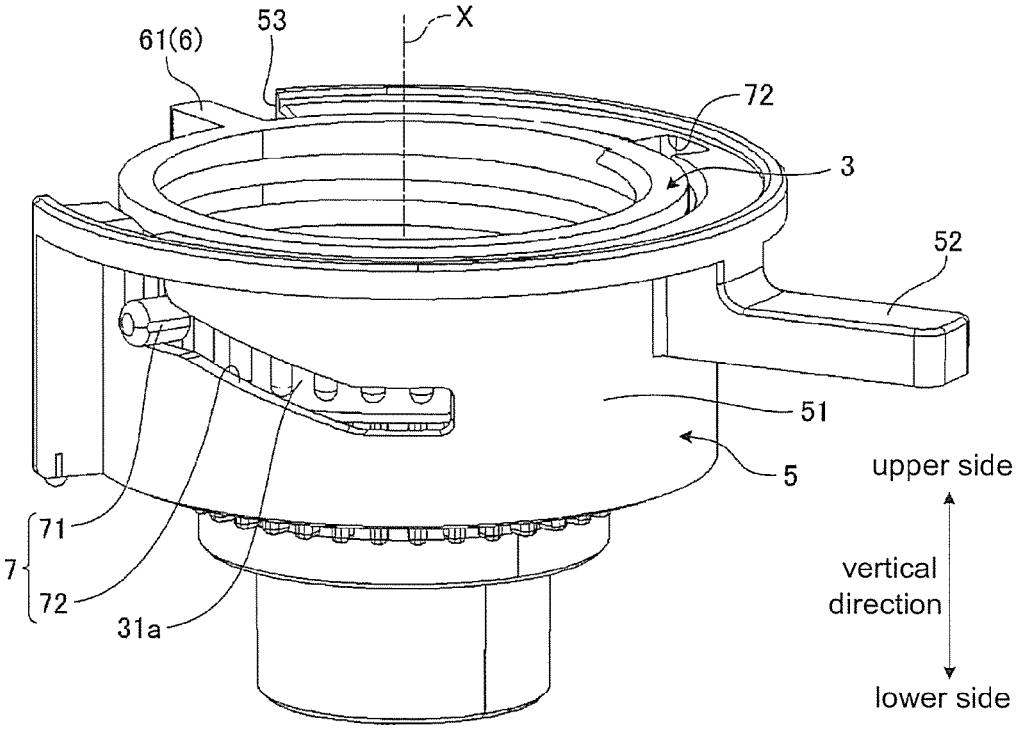
FIG. 12 is a perspective view of a pivotable lever and a cap of the ink supply unit according to the embodiments.
Figure 13:
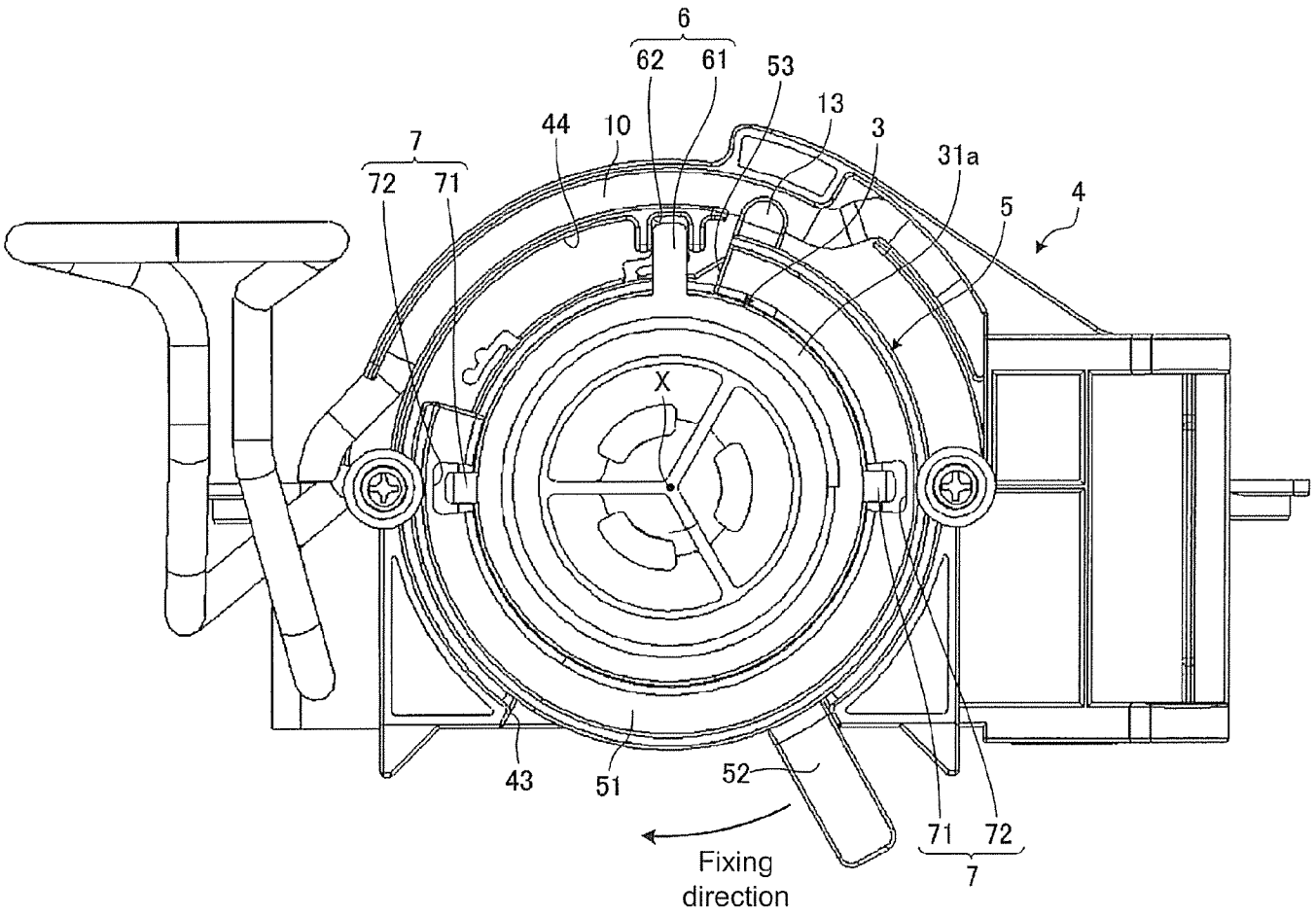
FIG. 13 is a plan view of the ink supply unit according to the embodiments viewed from a vertically upper side after the ink container is removed from the ink supply unit.
Figure 14:
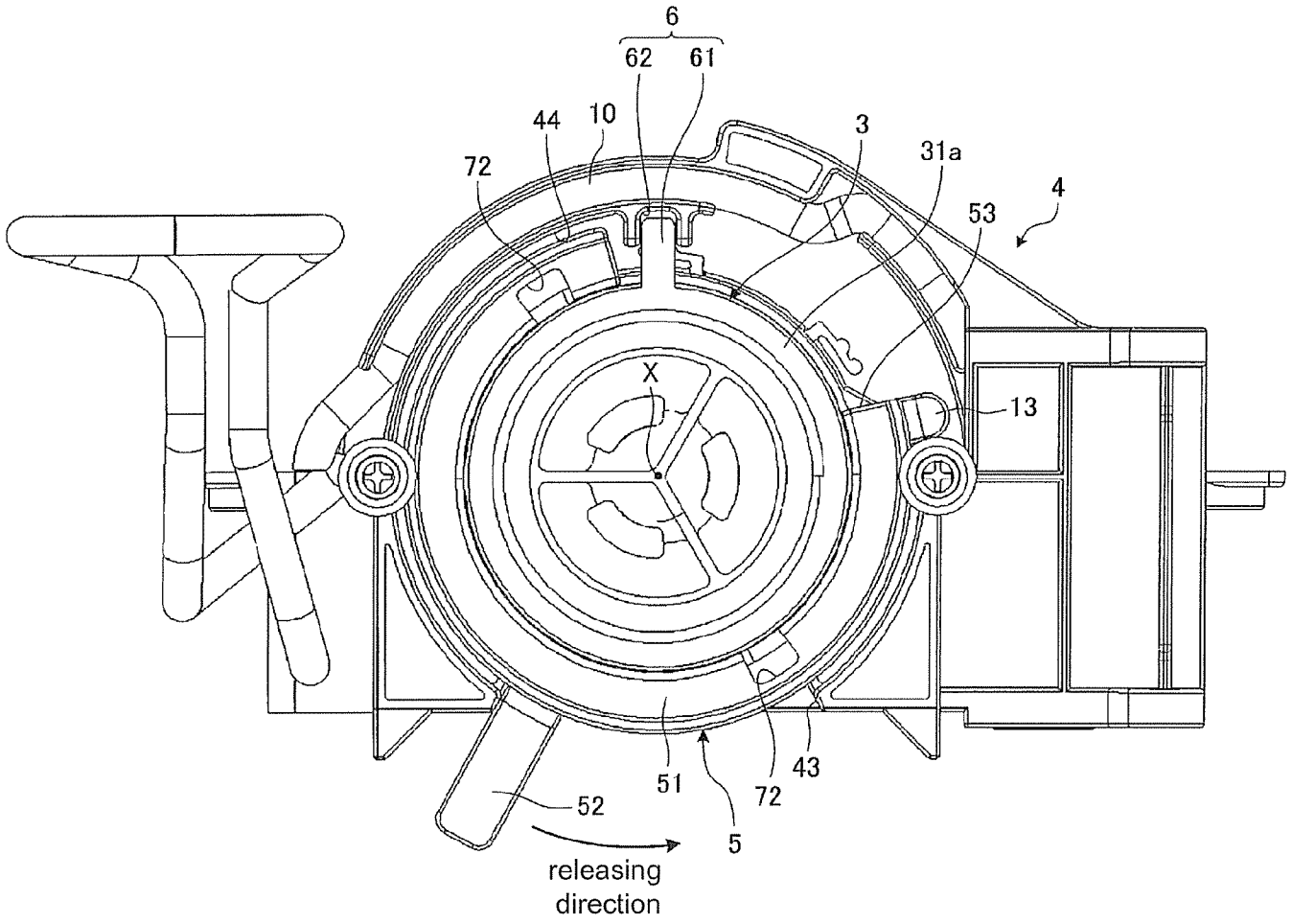
FIG. 14 is a plan view of the ink supply unit according to the embodiments viewed from the vertically upper side after the ink container is removed from the ink supply unit.
Figure 15:
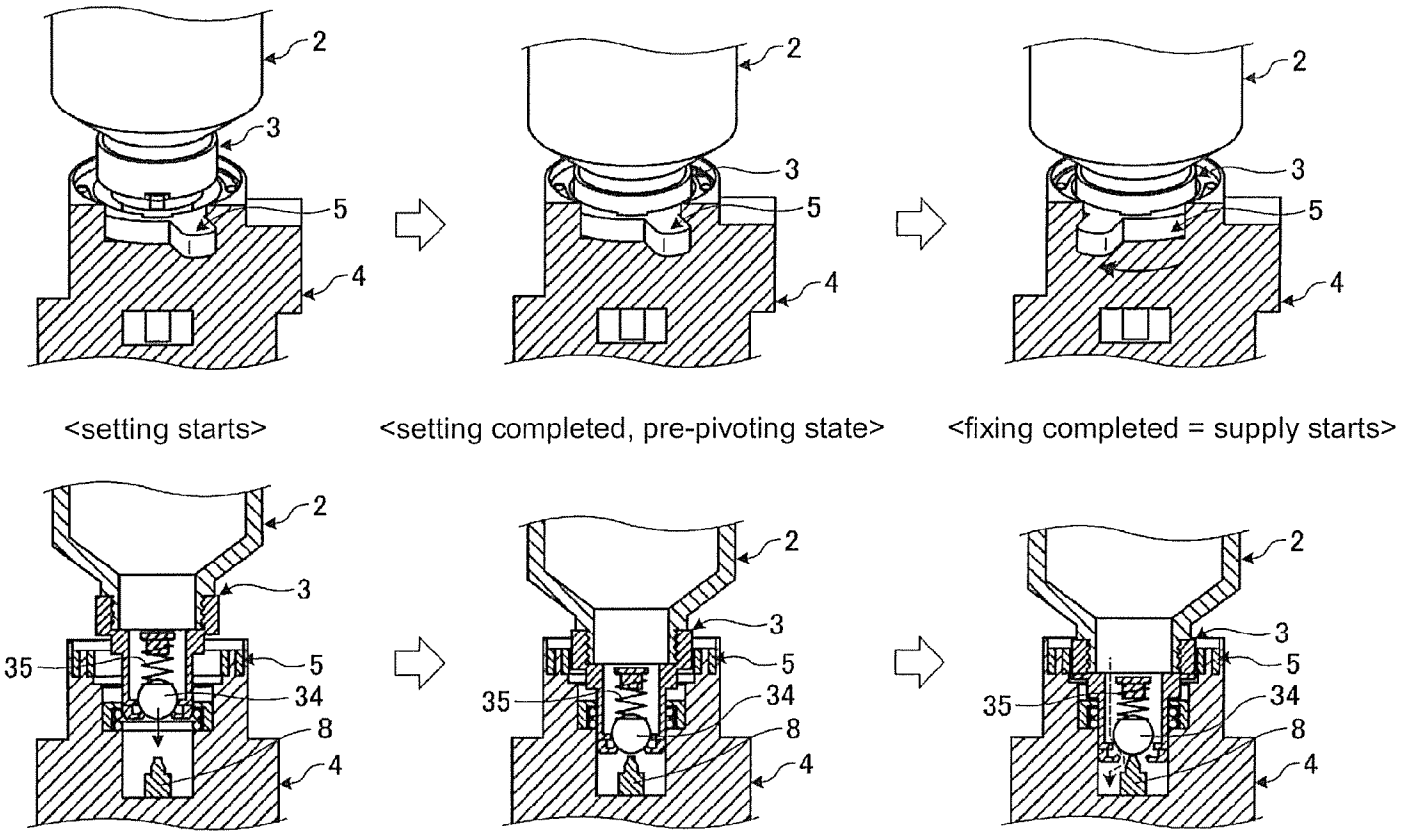
FIG. 15 is a schematic drawing illustrated to describe an operation of the ink supply unit according to the embodiments.

FIGS. 1, 2, and 3 are perspective views of exemplified inkjet printers to which an ink supply unit according to embodiments is applicable. FIGS. 4, 5, and 6 are schematic perspective views of exemplified ink containers applicable to the ink supply unit according to the embodiments. FIG. 7 is a perspective view, schematically illustrating structural features of the ink supply unit according to the embodiments. FIG. 8 is a perspective view in part of the ink supply unit according to the embodiments. In FIG. 8, a cabinet is partly not illustrated. FIG. 9 is a perspective view in part of the ink supply unit according to the embodiments partly illustrated in cross section. FIG. 10 is a cross-sectional view in part of the ink supply unit according to the embodiments. FIG. 11 is a perspective view in part of the ink supply unit according to the embodiments after the ink container is removed from the ink supply unit. FIG. 12 is a perspective view of a pivotable lever and a cap of the ink supply unit according to the embodiments. FIGS. 13 and 14 are plan views of the ink supply unit according to the embodiments viewed from a vertically upper side after the ink container is removed from the ink supply unit. FIG. 15 is a schematic drawing illustrated to describe an operation of the ink supply unit according to the embodiments.

As illustrated in FIGS. 1, 2, and 3, an ink supply unit 1 according to the present embodiment is an ink supply system usable in variously different inkjet printing apparatuses including vertical type and flatbed type; inkjet printers 100A, 100B, and 100C, to supply ink to the inkjet printers 100A, 100B, and 100C. The ink supply unit 1 is configured to replenish ink tanks 4 (see FIG. 8) with inks from ink containers 2 and then supply the inks from the ink tanks 4 to an inkjet head (printer head) of the inkjet printer 100A, 100B, 100C through an ink tube T (see FIG. 7). The inkjet printers 100A, 100B, 100C each are equipped with the ink supply unit 1, ink containers 2 for ink storage, and an inkjet head (not illustrated in the drawings). The inkjet head is connected via a connector to ink supply ports of the ink containers 2 to be supplied with the inks from the ink containers 2. The ink container 2 usable in the ink supply unit 1 may range in different types of containers, including a closed ink bottle illustrated in FIG. 4, an aluminum foil bag illustrated in FIG. 5, and a release-type (ink-replenishable type) ink bottle illustrated in FIG. 6. The ink containers 2 have caps 3, described later, be fitted thereto, and the inks are supplied into the ink tanks 4 through the caps 3. The ink containers 2 mounted in the ink supply unit 1 may be selected from any conventional ink bottles or aluminum foil bags in so far as the caps 3 are fitted thereto. The manner of fitting the cap 3 to the ink container 2 may be suitably changed depending on the type of the used container 2.

Specifically, the ink supply unit 1 according to this embodiment includes ink containers 2, caps 3, ink tanks 4, pivotable levers 5, anti-rotation mechanisms 6, conversion mechanisms 7, and valve-opening projections 8, as illustrated in FIGS. 7 to 12.

The ink supply unit 1 according to this embodiment is equipped with a plurality of sets of these components correspondingly to the number of printable colors, wherein each set consists of an ink container 2, a cap 3, an ink tank 4, a pivotable lever 5, an anti-rotation mechanism 6, a conversion mechanism 7, and a valve-opening projection 8. As illustrated in FIG. 7, the ink supply unit 1 described herein has eight sets, i.e., eight ink supply systems. The ink supply unit 1 has a cabinet 9, which is a box-shaped housing case, having an opening on its vertically upper side. As illustrated in FIGS. 7 and 8, the ink supply unit 1 has eight ink tanks 4 housed in the cabinet 9, and further has eight ink containers 2, correspondingly to the ink tanks 4, loaded in the opening on the vertically upper side of the cabinet 9. The ink tube T extends from a side surface of the cabinet 9. A description is hereinafter given to one of the eight sets, unless stated otherwise. The vertical direction of this ink supply unit 1 is coincident with a direction of insertion of the ink container 2 and the cap 3 into the ink tank 4.

The cap 3 having an opening 33 constitutes an ink supply port of the ink container 2. The pivotable lever 5 and the anti-rotation mechanism 6 constitute the connector described earlier. The connector is interposed between the ink supply port and the inkjet head. The connector has a pivotable lever 5 and an anti-rotation mechanism 6. The pivotable lever 5 is a rotary member disposed on one end side of the ink supply system having the inkjet head installed on the other end side thereof. The rotary member is independently rotatable and has a recess formed in the ink supply port and engaging a projection, or a projection formed in the liquid supply port and engaging a recess. The anti-rotation mechanism 6 is a stopper that stops rotation of the ink container. The ink supply system refers to an ink supply passage including the ink tube T. Rotation of the ink container 2 is stopped by the anti-rotation mechanism 6, and linear motion of the ink container 2 is effected by recess-projection relative movements in conjunction with the rotation of the pivotable lever 5. Then, the closed ink supply port (cap 3) is opened by the linear motion to supply the ink.

Specifically, the ink container 2 is a container that stores therein an ink. The ink container 2 may be any one of a closed ink bottle, an aluminum foil bag, or a release-type ink bottle as described earlier. Unless stated otherwise, the ink container 2 hereinafter described is a closed ink bottle. The ink container 2 described herein has a substantially cylindrical shape. The ink container 2 has one end part being closed and the other end part forming an ink flow-out opening 2*a* (see FIGS. 9 and 10) through which the ink flows out.

The cap 3 is fitted to the ink container 2. The cap 3 is a member in the form of a lid to be fitted to the ink flow-out opening 2*a* of the ink container 2. The cap 3 described herein is specifically a cylindrical screw cap.

More specifically, as illustrated in FIGS. 9 and 10, the cap 3 has an inner cylinder member 31 and an outer cylinder member 32 each having a cylindrical shape, an opening 33, a valve body 34, and an elastic body 35.

The inner cylinder member 31 has a cylinder portion 31*a*, a threaded groove 31*b*, a toroidal plate-like portion 31*c*, a valve body hole 31*d*, and a cylindrical spring holder 31*e*, all of which are integrally formed. The cylinder portion 31*a* has a cylindrical shape. The cylinder portion 31*a* has a plurality of stepped parts 31*f* and 31*g* in the form of a toroidal plate. The threaded groove 31*b* is formed in a spiral shape on the inner-peripheral surface side at one end part of the cylinder portion 31*a*. The toroidal plate-like portion 31*c* is formed in the shape of a toroidal plate on the inner-peripheral surface side at the other end part of the cylinder portion 31*a*. The cylinder portion 31*a* reduces in diameter by stages, at the stepped part 31*g*, and then at the stepped part 31*g*, in a direction from the threaded groove 31*b* toward the toroidal plate-like portion 31*c*. The valve body hole 31*d* is a circular hole formed in the toroidal plate-like portion 31*c*. The cylindrical spring holder 31*e* is formed in a cylindrical shape on the inner-peripheral surface side of the cylinder portion 31*a*. One end part of the cylindrical spring holder 31*e* is connected to the toroidal plate-like portion 31*c*. The cylindrical spring holder 31*e* extends from the toroidal plate-like portion 31*c* toward the threaded groove 31*b*. Of end parts of the cylindrical spring holder 31*e*, an end part nearer to the toroidal plate-like portion 31*c* communicates with the valve body hole 31*d*, and the other end part nearer to the threaded groove 31*b* is closed. The cylinder portion 31*a*, the toroidal plate-like portion 31*c*, the valve body hole 31*d*, and the cylindrical spring holder 31*e* are formed to be substantially coaxial.

The outer cylinder member 32 is mounted to the outer-peripheral surface side of the cylinder portion 31*a* of the inner cylinder member 31. The outer cylinder member 32 has a cylinder portion 32*a*, a toroidal plate-like portion 32*b*, and a toroidal plate-like portion 32*c*, all of which are integrally formed. The cylinder portion 32*a* has a cylindrical shape. The toroidal plate-like portion 32*b*, being mounted to one end part of the cylinder portion 32*a*, i.e., the inner cylinder member 31, is provided in the form of a toroidal plate on the outer-peripheral surface side at an end part nearer to the threaded groove 31*b*. The toroidal plate-like portion 32*c*, being mounted to the other end part of the cylinder portion 32*a*, i.e., the inner cylinder member 31, is provided in the form of a toroidal plate on the inner-peripheral surface side at an end part nearer to the toroidal plate-like portion 31*c*.

The opening 33 allows the ink stored in the ink container 2 to flow out therethrough. The opening 33 is a circular hole formed in the toroidal plate-like portion 31*c*. The opening 33 is smaller in diameter than the valve body hole 31*d*. The opening 33, the cylinder portion 32*a* of the outer cylinder member 32, the toroidal plate-like portion 32*b*, and the toroidal plate-like portion 32*c* are formed to be substantially coaxial.

The valve body 34 allows the opening 33 to open and close. The valve body 34 described herein is a spherical body (ball). The valve body 34 has an outer diameter smaller than the diameter of the valve body hole 31*d* and greater than the diameter of the opening 33.

The elastic body 35 biases the valve body 34 from the inner side of the ink container 2 toward a closing position. The elastic body 35 described herein is a helical compression spring.

The elastic body 35 of the cap 3 is held by the cylindrical spring holder 31*e* of the inner cylinder member 31, and the valve body 34 of the cap 3 is located at a position nearer to the valve body hole 31*d* of the elastic body 35. With the cap 3 being thus positioned, the outer cylinder member 32 is mounted to the inner cylinder member 31 from the direction of the toroidal plate-like portion 31*c*. In the cap 3 having the outer cylinder member 32 be mounted to the inner cylinder member 31, the stepped part 31*g* and the toroidal plate-like portion 32*b* are in contact against each other, while the toroidal plate-like portion 31*c* and the toroidal plate-like portion 32*c* are oppositely disposed with a predetermined interval therebetween. With the outer cylinder member 32 of the cap 3 being mounted to the inner cylinder member 31 thereof, the outer-peripheral surface of the cylinder portion 31*a* nearer to the toroidal plate-like portion 31*c* and the inner-peripheral surface of the cylinder portion 32*a* are in contact against each other. In the cap 3, the outer cylinder member 32 is mounted to the inner cylinder member 31, and the elastic body 35 and the valve body 34 are held. Then, the outer cylinder member 32 is secured to the inner cylinder member 31 with machine screws into an integral unit. With the inner cylinder member 31 and the outer cylinder member 32 being integrally joined, the threaded groove 31*b* is threaded into a threaded groove 2*b* of the ink container 2. As a result, the cap 3 is fitted to the ink container 2. The threaded groove 2*b* of the ink container 2 is formed on the outer-peripheral surface side in a projecting part of the ink container 2 where the ink flow-out opening 2*a* is formed. In the cap 3 thus having the inner cylinder member 31 and the outer cylinder member 32 be integrally joined, the valve body 34 is pressed by the energizing force of the elastic body 35 toward the opening 33, specifically, pressed from the inner side of the ink container 2 toward the closing position.

With the cap 3 being fitted to the ink container 2, a toroidal sealing member 36 is interposed between the stepped part 31*f* and an end part of the ink container 2 where the ink flow-out opening 2*a* is formed. The sealing member 36, after the cap 3 is fitted to the ink container 2, serves to seal any gap between the stepped part 31*f* and the end part where the ink flow-out opening 2*a* is formed, thereby preventing leakage of the ink. The cap 3 is further provided with a toroidal O-ring 37 at a position along the outer periphery of the opening 33 between the toroidal plate-like portion 31*c* and the toroidal plate-like portion 32*c*. The O-ring 37 serves to seal any gap between the valve body 34 and the opening 33 when the valve body 34 is closed, thereby preventing leakage of the ink. Furthermore, a toroidal O-ring 38 is fitted to the outer-peripheral surface of the stepped part 31*g* of the cap 3. The O-ring 38 serves to seal any gap between the cap 3 and an ink storage space wall surface 41*a* described later after the ink container 2 and the cap 3 are securely held in the ink tank 4, thereby preventing leakage of the ink. This will be described later in further detail.

As illustrated in FIGS. 8, 9, and 10, the ink tank 4 holds the ink container 2 fitted with the cap 3 at a cap 3-side part of the ink container 2. The ink tank 4 is housed in the cabinet 9 as described earlier. The ink tank 4 has an ink storage space 41 for storage of the ink supplied from the ink container 2. The ink storage space wall surface 41*a* is a cylindrical wall surface that defines the ink storage space 41. The ink storage space 41 thereby defined has the shape of a circular cylinder. The cap 3-side part of the ink container 2 is held in the ink storage space 41 via the pivotable lever 5 described later.

The ink supply unit 1 further has an open-to-atmosphere tube 10 communicating inside of the ink tank 4 with the atmosphere (see FIGS. 7, 9, 10, and 11). The open-to-atmosphere tube 10 may include a rubber tube. With the ink container 2 being held in the ink tank 4, the open-to-atmosphere tube 10 communicates the inner side of the ink tank 4, i.e., the ink storage space 41, with outside, opening inside of the ink storage space 41 to the atmosphere. The ink supply unit 1 further has an openable and closable lid member 11 (see FIGS. 7 and 8) that covers the ink storage space 41 at the time of removal of the ink container 2 from the ink tank 4 to prevent the ink from flying out.

As illustrated in FIGS. 9, 10, 11, and 12, the pivotable lever 5 is disposed on the ink tank 4 so as to freely pivot on a pivoting center that is a pivot axis X. The pivotable lever 5 has a cylindrical portion 51 and a lever portion 52, which are integrally formed. The cylindrical portion 51 has a cylindrical shape. The cylindrical portion 51 is pivotably supported by the ink tank 4. The cap 3 and the ink container 2 are inserted in the cylindrical portion 51 on its inner-peripheral surface side. The cylindrical portion 51 is supported by a toroidal guiding groove 42 formed in the ink storage space wall surface 41*a*. The toroidal guiding groove 42 is formed in depth in the ink storage space wall surface 41*a*. The toroidal guiding groove 42 has a toroidal shape in a vertical view. The lever portion 52 is a bar-shaped portion radially projecting from the cylindrical portion 51. The lever portion 52 is exposed out of the cabinet 9 through a notch 43 formed in the ink tank 4 (see also FIG. 13) and a notch 9*a* formed in the cabinet 9. The cylindrical portion 51 has an arc-shaped notch 53 formed at a position radially (direction intersecting with the pivot axis X) facing the lever portion 52. The cylindrical portion 51 of the pivotable lever 5 is supported by the toroidal guiding groove 42 so that the pivot axis X is positioned along the vertical direction. The lever portion 52 thus arranged, when manually pivoted, is pivotable around the pivot axis X. A vertically upper end side of the cylindrical portion 51 of the pivotable lever 5 is positioned with machine screws 54 (see FIG. 11) in a manner that the pivotable lever 5 is pivotable in the toroidal guiding groove 42 of the ink tank 4 and prevented from falling off the toroidal guiding groove 42. The notches 43 and 9*a* are formed at positions and in dimensions appropriate for deterring the pivoting motion of the pivotable lever 5 from interfering with the movement of the lever portion 52.

As illustrated in FIGS. 9, 10, 11, 12, and 13, the anti-rotation mechanism 6 restricts relative rotations of the ink container 2 and of the cap 3 to the ink tank 4, with the ink container 2 being held in the ink tank 4. The anti-rotation mechanism 6 has an anti-rotation projection 61 and an anti-rotation engaging portion 62. The anti-rotation projection 61 has a plate-like shape radially projecting from the cap 3 or the ink container 2. The anti-rotation projection 61 described herein is formed at an end part of the cylinder portion 31*a* of the cap 3 nearer to the threaded groove 31*b*. Instead, the anti-rotation projection 61 may be formed at a part of the cylinder portion 31*a* nearer to the ink container 2. The anti-rotation engaging portion 62 is formed in the ink tank 4 and engageable with the anti-rotation projection 61. The anti-rotation engaging portion 62 is formed in a wall surface 44 on the vertically upper end side of the ink tank 4 and on the radially outer side of the toroidal guiding groove 42. The wall surface 44 is a cylindrical wall surface. The anti-rotation engaging portion 62 is a grooved portion formed in the wall surface 44. The anti-rotation engaging portion 62 described herein is formed of two circumferentially opposing ribs. The anti-rotation engaging portion 62, with the ink tank 4 being set in the cabinet 9, extends to the toroidal guiding groove 42 along the insertion direction of the cap 3, i.e., the vertical direction. The anti-rotation projection 61 is formed in a dimension long enough to reach the anti-rotation engaging portion 62 through the notch 53 of the pivotable lever 5 after the cap 3 and the ink container 2 are inserted in the cylindrical portion 51 of the pivotable lever 5. To mount the ink container 2 and the cap 3 in the cylindrical portion 51 of the pivotable lever 5, the anti-rotation projection 61 of the anti-rotation mechanism 6 is inserted in the anti-rotation engaging portion 62 from the vertically upper side. With the ink container 2 being held in the ink tank 4, the anti-rotation projection 61 of the anti-rotation mechanism 6 is engaged with the anti-rotation engaging portion 62 thereof. This arrangement may restrict relative rotations around the pivot axis X of the ink container 2 and of the cap 3 to the ink tank 4.

As illustrated in FIGS. 11, 12, 13, and 14, the conversion mechanism 7 converts the pivoting motion of the pivotable lever 5 into linear motions of the ink container 2 and of the cap 3 in a direction along the pivot axis X. The conversion mechanism 7 has guiding projections 71 and guiding recesses 72, which are respectively examples of the projection and the recess. The guiding projection 71 is a columnar portion radially projecting from the cap 3. The guiding projections 71 are formed in a pair on the outer-peripheral surface of the cylinder portion 31*a* of the cap 3. The guiding projections 71 are formed in a pair at substantially symmetrical positions along the outer-peripheral surface of the cylinder portion 31*a*. The anti-rotation projection 61 is located at a middle position between the paired guiding projections 71 along the outer-peripheral surface of the cylinder portion 31*a*. The guiding recesses 72 are formed in the cylindrical portion 51 of the pivotable lever 5. The guiding recess 72 described herein is a through hole penetrating through the wall surface of the cylindrical portion 51. Optionally, the guiding recess 72 may be a hole not penetrating through the wall surface of the cylindrical portion 51. The guiding recesses 72 are inclined relative to the direction along the pivot axis X. The guiding recesses 72 are formed in a pair correspondingly to the paired guiding projections 71. The guiding recesses 72 receive the guiding projections 71 inserted therein. More specifically, with the pivotable lever 5 being set on the ink tank 4, the guiding recesses 72 are inclined by degrees counterclockwise around the pivot axis X, from the vertically upper side toward the vertically lower side, as illustrated in FIG. 12. The guiding recesses 72 each have a vertically upper end that opens on the vertically upper end side of the cylindrical portion 51. On the other hand, vertically lower ends of these recesses are shaped substantially along the horizontal direction. To insert the ink container 2 and the cap 3 in the cylindrical portion 51 of the pivotable lever 5, the paired guiding projections 71 of the conversion mechanism 7 are inserted in openings on the vertically upper end sides of the guiding recesses 72. With the guiding projections 71 of the conversion mechanism 7 being inserted in the guiding recesses 72 thereof, the guiding recesses 72 guide the guiding projections 71 in the direction along the pivot axis X in conjunction with relative rotations of the pivotable lever 5 and of the cap 3. The conversion mechanism 7, with relative rotations of the ink container 2 and of the cap 3 being restricted, may convert the pivoting motion of the pivotable lever 5 into linear motions of the ink container 2 and of the cap 3 in the direction along the pivot axis X. To put it differently, the pivoting motion of the pivotable lever 5 may prompt the conversion mechanism 7 to move the ink container 2 and the cap 3 in the direction along the pivot axis X. The direction along the pivot axis X typically refers to the vertical direction. This direction described herein corresponds to a direction in which the ink container 2 and the cap 3 move toward and away from the ink tank 4, i.e., a direction in which the ink container 2 and the cap 3 are inserted in the ink tank 4.

The anti-rotation projection 61 of the cap 3, the paired guiding projections 71, the anti-rotation projection 62 on the wall surface 44 of the ink tank 4, and the paired guiding recesses 72 of the pivotable lever 5 have a positional relationship in which the paired guiding projections 71 are respectively insertable in the paired guiding recesses 72 and the anti-rotation projection 61 is insertable in the anti-rotation engaging portion 62, after the pivotable lever 5 is set on the ink tank 4, and the cap 3 and the ink container 2 are inserted in the cylindrical portion 51 of the pivotable lever 5.

As illustrated in FIGS. 9 and 10, a valve-opening projection 8 is formed inside the ink tank 4, i.e., the ink storage space 41. The valve-opening projection 8 is formed vertically on an ink storage space bottom surface 41*b* that defines the ink storage space 41. The valve-opening projection 8 is formed at a position vertically opposite to the opening 33 of the cap 3, after the pivotable lever 5 is disposed on the ink tank 4, and the cap 3 and the ink container 2 are inserted in the cylindrical portion 51 of the pivotable lever 5. The valve-opening projection 8 presses the valve body 34 toward an opening position when the cap 3 is drawn nearer to the ink tank 4 by the linear motions of the ink container 2 and of the cap 3.

As described earlier, the ink supply unit 1 includes the open-to-atmosphere tube 10 that communicates the ink storage space 41 of the ink tank 4 with outside, opening inside of the ink storage space 41 to the atmosphere. As illustrated in FIGS. 7 and 13, the open-to-atmosphere tube 10 is guided by a tube standing plate 12 from the ink tank 4 to the vertically upper side of the ink container 2, and then travels again on the outer-peripheral surface side of the wall surface 44 nearer to the ink tank 4. Thus, the open-to-atmosphere tube 10 at least extends to the vertically upper side of the ink container 2. As illustrated in FIGS. 13 and 14, the ink supply unit 1 according to this embodiment further includes an open-to-atmosphere projection 13 allowed to press the open-to-atmosphere tube 10 in conjunction with the pivoting motion of the pivotable lever 5. The open-to-atmosphere projection 13 is formed on the pivotable lever 5. The open-to-atmosphere projection 13 is formed so as to project from the outer-peripheral surface of the cylindrical portion 51. The open-to-atmosphere projection 13 is adjacent to one end part of the notch 53. The open-to-atmosphere projection 13 is allowed to move to and from a releasing position and a constricting position. The open-to-atmosphere tube 10 is released at the releasing position and is pressed to be constricted at the constricting position in conjunction with the pivoting motion of the pivotable lever 5. As illustrated in FIG. 13, the open-to-atmosphere projection 13 is located at the constricting position at which the open-to-atmosphere tube 10 is pressed to be constricted at least when the lever portion 52 of the pivotable lever 5 is located in the notch 43 on the rightmost side on the drawing. As illustrated in FIG. 14, the open-to-atmosphere projection 13 is located at the releasing position at which the open-to-atmosphere tube 10 is released when the lever portion 52 of the pivotable lever 5 is located in the notch 43 on the leftmost side on the drawing. As described below, the open-to-atmosphere projection 13 is located at the releasing position when the valve body 34 is at the opening position, and is located at the constricting position when the valve body 34 is at the closing position.

The operation of the ink supply unit 1 is hereinafter described referring to FIG. 15. The structural elements of the ink supply unit 1 are described referring to FIGS. 9, 12, 13, 14, and 15. A pivoting direction of the pivotable lever 5 defined in the description below is a direction viewed from the vertically upper side.

In the ink supply unit 1, before the ink tank 4 starts to be replenished with the ink, the ink container 2 fitted with the cap 3 is inserted in the cylindrical portion 51 of the pivotable lever 5 from the direction of the cap 3 (setting starts), as illustrated on the left row of FIG. 15. The middle row of FIG. 15 illustrates the completion of setting of the ink container 2, at which time the pivotable lever 5 is yet to be pivoted (setting completed, pre-pivoting state). At this point, the pivotable lever 5 is situated as illustrated in FIG. 13. Specifically, the paired guiding projections 71 of the cap 3 are located in the openings on the vertically upper sides of the paired guiding recesses 72, and the lever portion 52 of the pivotable lever 5 is located in the notch 43 on the rightmost side on the drawing of FIG. 13. At this point, the ink container 2 is still unfixed and removable from the ink tank 4, and the valve body 34 is located at the closing position. In the ink tank 4, there is still a gap between the ink storage space wall surface 41*a* and the O-ring 38 fitted to the cap 3, and the gap has not been tightly sealed yet. Moreover, the open-to-atmosphere projection 13 is located at the constricting position at which the open-to-atmosphere tube 10 is pressed to be constricted. The open-to-atmosphere projection 13 located at this position is blocking the ink storage space 41 from communicating with the atmosphere through the open-to-atmosphere tube 10. The ink supply unit 1 in the described condition is not ready to supply the ink from the ink container 2 into the ink tank 4.

In the setting-completed ink supply unit 1, the pivotable lever 5, currently in the pre-pivoting state, starts to be pivoted clockwise (fixing direction), as illustrated in FIG. 13, to move the cap 3 and the ink container 2 in the direction along the pivot axis X. The movement here is directed toward the vertically lower side. Specifically, the cap 3 and the ink container 2 move along the pivot axis X toward the valve-opening projection 8 formed on the ink storage space bottom surface 41*b* of the ink tank 4. In further detail, the pivotable lever 5 is pivoted in the fixing direction, with relative rotations of the ink container 2 and of the cap 3 being restricted by the anti-rotation mechanism 6. Then, the guiding recesses 72 press the guiding projections 71 toward the vertically lower side in conjunction with the pivoting motion of the pivotable lever 5. As a result, in the ink supply unit 1, the cap 3 with the guiding projections 71 formed thereon and the ink container 2 integral with the cap 3, with their rotations being restricted, move toward the vertically lower side, i.e., toward the valve-opening projection 8.

As illustrated in FIG. 14, the pivotable lever 5 is pivoted until the lever portion 52 arrives at a position in the notch 43 on the leftmost side on the drawing to guide the guiding projections 71 to the horizontal parts at the vertically lower ends of the guiding recesses 72. In the ink supply unit 1 thus arranged, the ink container 2 is fixed to the ink tank 4 via the cap 3 and the pivotable lever 5, as illustrated on the right row of FIG. 15 (fixing completed). Then, the valve-opening projection 8 pushes the valve body 34 upward to the opening position against the energizing force of the elastic body 35, releasing the sealing performance by the O-ring 37. In the ink tank 4, at this point, any gap between the cap 3 and the ink storage space wall surface 41*a* is tightly sealed with the O-ring 38. Moreover, the open-to-atmosphere projection 13 is located at the releasing position at which the open-to-atmosphere tube 10 is released. The open-to-atmosphere projection 13 located at this position allows the ink storage space 41 to communicate with the atmosphere through the open-to-atmosphere tube 10. As a result, the ink in the ink container 2 is supplied into the ink storage space 41 of the ink tank 4 through the gap between the valve body 34 and the opening 33 (supply starts). At this point, the stepped part 41*c* formed in the shape of a toroidal plate on the ink storage space wall surface 41*a* and the toroidal plate-like portion 31*c* of the cap 3 are vertically in contact against each other.

To remove the ink container 2 from the ink tank 4, the pivotable lever 5 is pivoted in a direction reverse to the before-mentioned direction. In the ink supply unit 1, with the ink container 2 being fixed in the ink tank 4, the pivotable lever 5 is pivoted counterclockwise (releasing direction), as illustrated in FIG. 14, to move the cap 3 and the ink container 2 in the direction along the pivot axis X. The movement here is directed toward the vertically upper side. As a result, the cap 3 and the ink container 2 move along the pivot axis X away from the valve-opening projection 8. In further detail, the pivotable lever 5 is pivoted in the releasing direction, with relative rotations of the ink container 2 and of the cap 3 being restricted by the anti-rotation mechanism 6, and the guiding recesses 72 press the guiding projections 71 toward the vertically upper side in conjunction with the pivoting motion of the pivotable lever 5. Then, the cap 3 with the guiding projections 71 formed thereon and the ink container 2 integral with the cap 3, with their rotations being restricted, move toward the vertically upper side, i.e., away from the valve-opening projection 8. Accordingly, the valve-opening projection 8 no longer presses the valve body 34, and the valve body 34 is pushed back to the closing position by the energizing force of the elastic body 35. As a result, the sealing performance by the O-ring 37 is resumed to stop the ink supply through the gap between the valve body 34 and the opening 33. As illustrated in FIG. 13, the pivotable lever 5 is pivoted until the lever portion 52 arrives at a position in the notch 43 on the rightmost side on the drawing, allowing the ink container 2 and the cap 3 to be removed from the ink tank 4. At this point, the open-to-atmosphere projection 13 is located at the constricting position at which the open-to-atmosphere tube 10 is pressed to be constricted as described earlier referring to FIG. 13. The open-to-atmosphere projection 13 located at this position is blocking the ink storage space 41 from communicating with the atmosphere through the open-to-atmosphere tube 10. This may prevent the ink remaining in the open-to-atmosphere tube 10 from flowing out into the ink tank 4 at the time of removal of the ink container 2 and the cap 3 from the ink tank 4.

By moving the lever portion 52 in the fixing direction, the ink container 2 is fixed in the ink tank 4, the open-to-atmosphere tube 10 is opened (open-to-atmosphere projection 13 is released), and the ink supply starts through the gap defined by a degree of contact between the valve body 34 and the valve-opening projection 8. Thus, the ink supply unit 1 may be capable of achieving the three functions by simply manipulating the lever portion 52 once. By moving the lever portion 52 in the releasing direction, the ink container 3 is removed from the ink tank 4, the open-to-atmosphere tube 10 is constricted (by the open-to-atmosphere projection 13), and the valve body 34 and the open-to-atmosphere projection 8 move away from each other to close the gap, stopping the ink supply. Thus, the ink supply unit 1 may be capable of achieving the three functions by simply manipulating the lever portion 52 once. This ink supply unit 1 may advantageously improve handleability at the time of insertion and removal of the ink container 2 and also suppress users' operational variability.

In the ink supply unit 1 and the inkjet printers 100A, 100B, and 100C thus characterized, the cap 3 and the ink container 2 are inserted in the pivotable lever 5, and the pivotable lever 5 is pivoted with rotations of the ink container 2 and of the cap 3 being restricted by the anti-rotation mechanism 6. The pivoting motion of the pivotable lever 5 is converted by the conversion mechanism 7 into linear motions of the ink container 2 and of the cap 3, and the cap 3 is drawn nearer to the ink tank 4 by the linear motions to have the valve body 34 of the cap 3 be opened by the valve-opening projection 8. Resultantly, the ink tank 4 may be replenished with the ink from the ink container 2. In the ink supply unit 1, pivoting the pivotable lever 5 in the reverse direction moves the ink container 2 and the cap 3 away from the ink tank 4 to close the valve body 34 of the cap 3, stopping the ink replenishment for the ink tank 4. The ink supply unit 1 thus configured and operated may successfully improve workability of ink replenishment for the ink tank 4.

The ink supply unit 1, by setting the ink container 2 in the ink tank 4 and pivoting the pivotable lever 5, may initiate and end the ink replenishment. Therefore, the ink supply from the ink container 2 into the ink tank 4 may be successfully completed with relative rotations of the ink container 2 and of the cap 3 being restricted. The ink supply unit 1 may effectively prevent the cap 3 from accidentally loosening, thereby reducing the likelihood of ink leakage during the ink replenishment. This may ensure safety of the ink supply from the ink container 2 into the ink tank 4. The ink supply unit 1 is further advantageous in that insertion and removal of the ink container 2 in and out of the ink tank 4 may be safely and mechanically enabled by simply pivoting the pivotable lever 5. This may lessen users' operational variability, affording improved workability for different users.

Further advantageously, the open-to-atmosphere tube 10 may be constricted or opened by the open-to-atmosphere projection 13 in conjunction with the pivoting motion of the pivotable lever 5 at the time of inserting and removing the ink container 2 in and out of the ink tank 4. The ink supply unit 1 may resultantly perform adequate ink replenishment by opening the ink tank 4 to the atmosphere and also prevent the ink remaining in the open-to-atmosphere tube 10 from flowing out into the ink tank 4 at the time of removal of the ink container 2.

The ink supply unit 1 according to this embodiment described earlier includes the ink containers 2, caps 3, ink tanks 4, pivotable levers 5, anti-rotation mechanisms 6, conversion mechanisms 7, and valve-opening projections 8. The ink containers 2 each contain an ink. The cap 3 is fitted to the ink container 2. The cap 3 has the opening 33 that allows the ink stored in the ink container 2 to flow out therethrough, the valve body 34 that allows the opening 33 to open and close, and the elastic body 35 that biases the valve body 34 from the inner side of the ink container 2 toward the closing position. The ink tank 4 holds the ink container 2 fitted with the cap 3 at the cap 3-side part of the ink container 2. The pivotable lever 5 is disposed on the ink tank 4 pivotably on the pivot axis X which is the pivoting center. The anti-rotation mechanism 6 restricts relative rotations of the ink container 2 and of the cap 3 to the ink tank 4, with the ink container 2 being held in the ink tank 4. The conversion mechanism 7 converts the pivoting motion of the pivotable lever 5 into linear motions of the ink container 2 and of the cap 3 in the direction along the pivot axis X. The valve-opening projection 8 is formed inside the ink tank 4. The valve-opening projection 8 presses the valve body 34 toward the opening position when the cap 3 is drawn nearer to the ink tank 4 by the linear motions of the ink container 2 and of the cap 3.

The inkjet printers 100A, 100B, and 100C provided as examples of the inkjet printing apparatus each include ink containers 2 for ink storage, and an inkjet head connected via connectors to ink supply ports (caps 3) of the ink containers 2 to be supplied with the inks from the ink containers 2, wherein the connectors each include a pivotable lever 5 and an anti-rotation mechanism 6. The pivotable lever 5 is disposed on one end side of the ink supply system (ink tube T) having the inkjet head disposed on the other end side thereof. The pivotable lever 5 is independently pivotable and has recesses (guiding recesses 72) formed in the ink supply port and engaging a projection (guiding projection 71), or a projection formed in the liquid supply port and engaging a recess. The anti-rotation mechanism 6 stops rotation of the ink container 2. Rotation of the ink container 2 is stopped by the anti-rotation mechanism 6, and linear motion of the ink container 2 is effected by recess-projection relative movements in conjunction with the pivoting motion of the pivotable lever 5. Then, the closed ink supply port is opened by the linear motion to supply the ink.

The ink supply unit 1 and the inkjet printers 100A, 100B, and 100C, by setting the ink container 2 in the ink tank 4 and pivoting the pivotable lever 5, may initiate and end the ink replenishment, improving workability of ink replenishment for the ink tank 4.

The ink supply unit and the inkjet printing apparatus according to the embodiment of the present invention may not necessarily be configured as described so far, and may be variously modified within the scope of the appended claims.

Although it has so far been described that the recesses (guiding recesses 72) are formed at positions nearer to the rotary member (pivotable lever 5), and the projections (guiding projections 71) are formed at positions nearer to the ink supply port (cap 3), these positions of the recesses and projections may be reversed. Also, it has so far been described that that the guiding recess 72 is an example of the recess, and the guiding projection 71 is an example of the projection. Instead, they may be an external threaded groove and an internal threaded groove threaded into each other.

Second Embodiment

Figure 16:
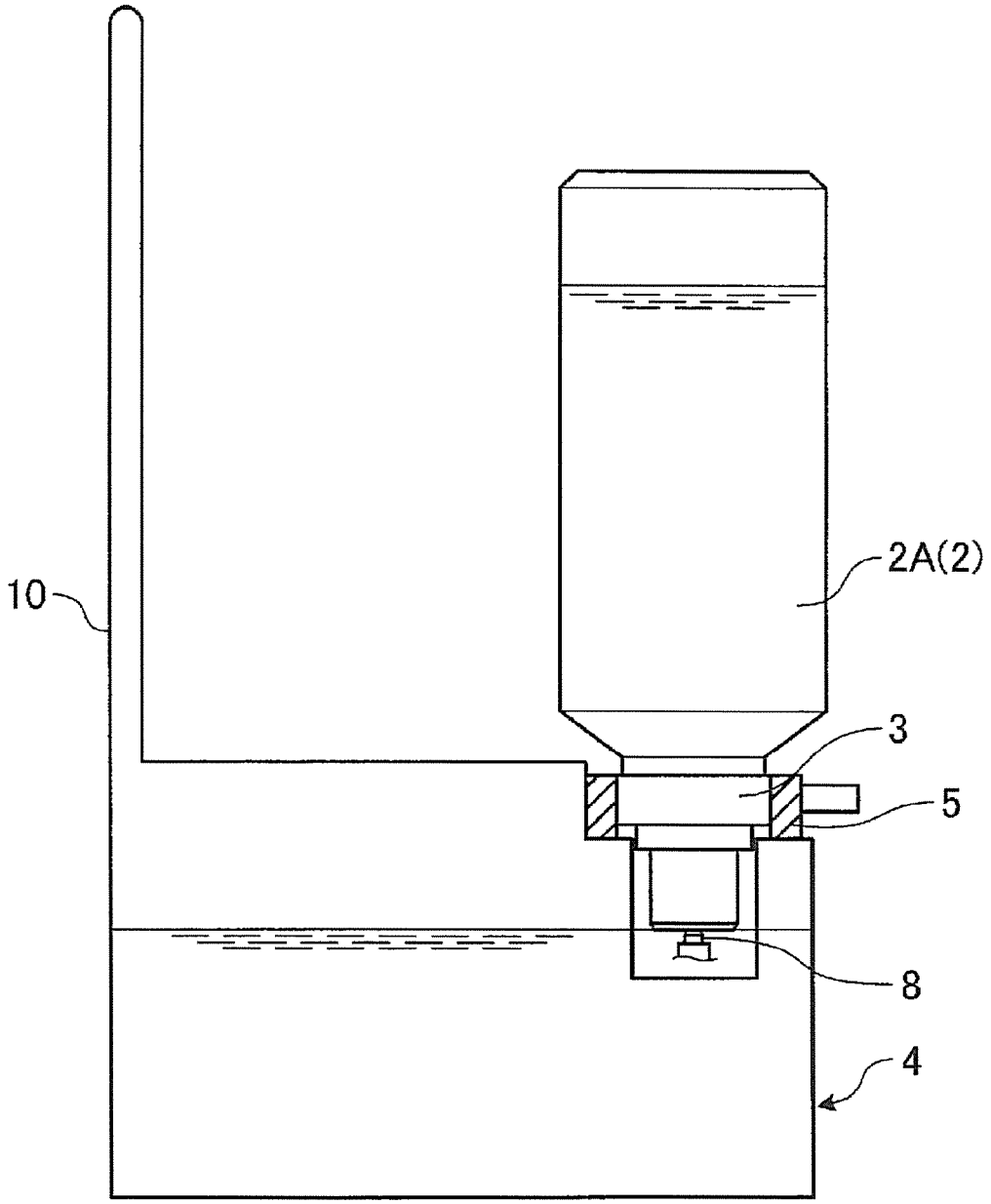
FIG. 16 is a schematic cross-sectional view illustrated to describe changes of an ink liquid level in the ink supply unit according to the embodiments.
Figure 17:
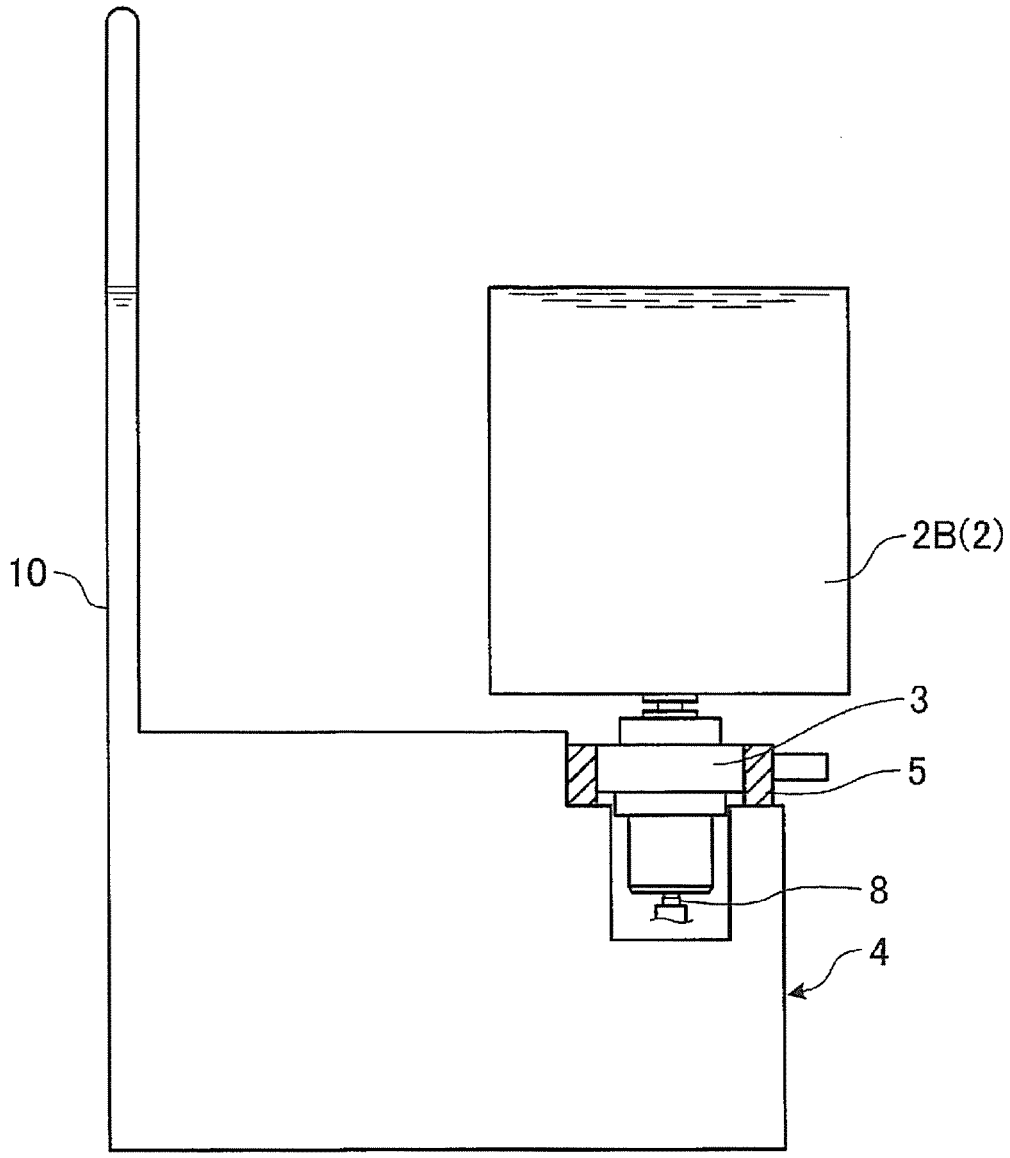
FIG. 17 is a schematic cross-sectional view illustrated to describe changes of an ink liquid level in the ink supply unit according to the embodiments.
Figure 18:
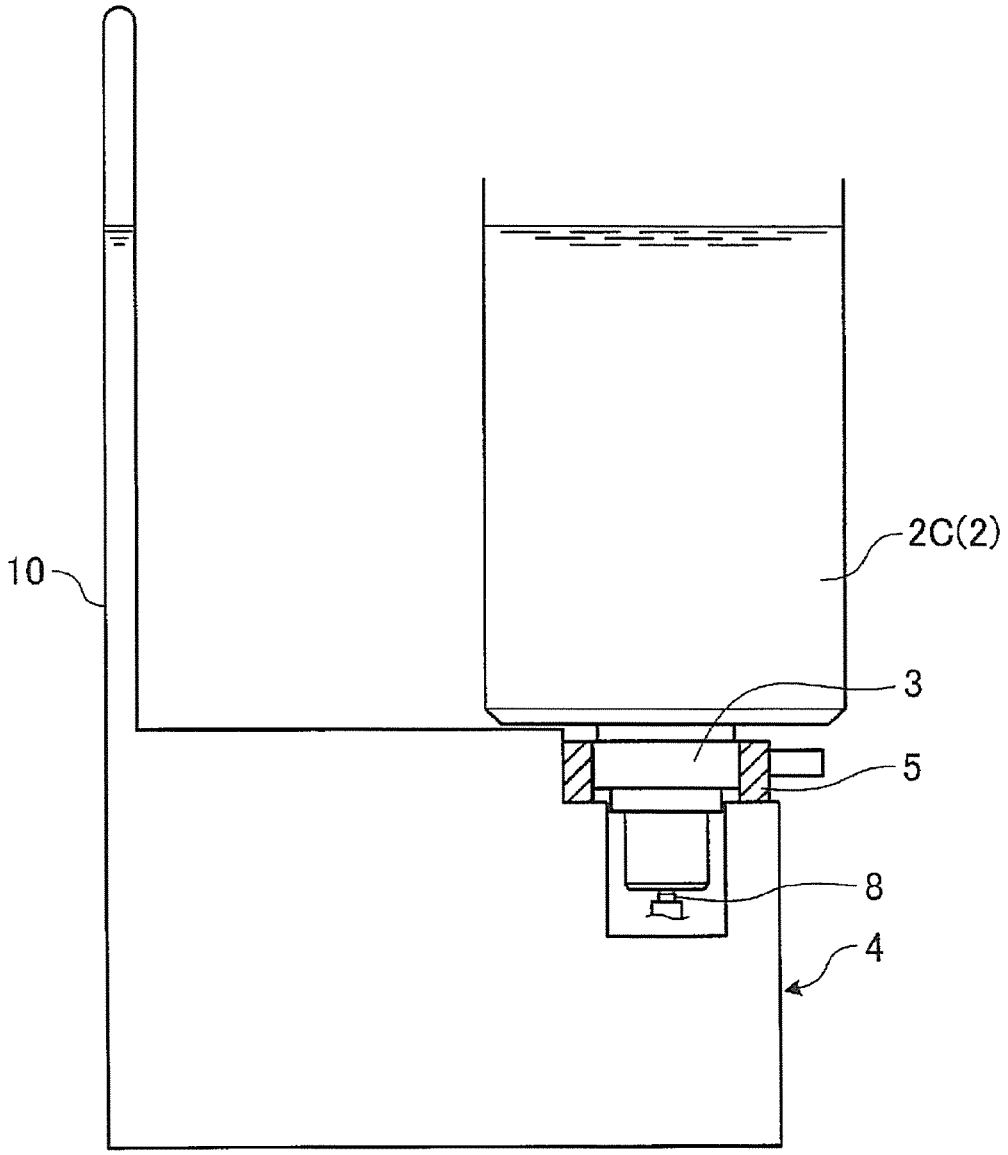
FIG. 18 is a schematic cross-sectional view illustrated to describe changes of an ink liquid level in the ink supply unit according to the embodiments.

FIGS. 1, 2, and 3 are perspective views of exemplified inkjet printers to which an ink supply unit according to embodiments is applicable. FIGS. 4, 5, and 6 are schematic perspective views of exemplified ink containers applicable to the ink supply unit according to the embodiments. FIG. 7 is a perspective view, schematically illustrating structural features of the ink supply unit according to the embodiments. FIG. 8 is a perspective view in part of the ink supply unit according to the embodiments. In FIG. 8, a cabinet is partly not illustrated. FIG. 9 is a perspective view in part of the ink supply unit according to the embodiments partly illustrated in cross section. FIG. 10 is a cross-sectional view in part of the ink supply unit according to the embodiments. FIG. 11 is a perspective view in part of the ink supply unit according to the embodiments after the ink container is removed from the ink supply unit. FIG. 12 is a perspective view of a pivotable lever and a cap of the ink supply unit according to the embodiments. FIGS. 13 and 14 are plan views of the ink supply unit according to the embodiments viewed from a vertically upper side after the ink container is removed from the ink supply unit. FIG. 15 is a schematic drawing illustrated to describe an operation of the ink supply unit according to the embodiments. FIGS. 16, 17, and 18 are schematic cross-sectional views illustrated to describe changes of an ink liquid level in the ink supply unit according to the embodiments.

As illustrated in FIGS. 1, 2, and 3, an ink supply unit 1 according to the present embodiment is an ink supply system usable in variously different inkjet printing apparatuses including vertical type and flatbed type; inkjet printers 100A, 100B, and 100C, to supply ink to the inkjet printers 100A, 100B, and 100C. In the ink supply unit 1, inks, i.e., liquids, are supplied from ink containers 2, i.e., liquid storage containers, into ink tanks 4, i.e., liquid tanks (see FIG. 8). The inkjet head (printer head) of the inkjet printer 100A, 100B, 100C is supplied with the inks from the ink tanks 4 through the ink tube T constituting the liquid supply system (see FIG. 7). The inkjet printers 100A, 100B, and 100C each are equipped with the ink supply unit 1 including the ink containers (liquid storage containers) 2 for ink (liquid) storage, and ink tanks (liquid tanks) 4 disposed on the vertically lower sides of the ink containers 2 to store therein the inks supplied from the ink containers 3, the ink tanks 4 each having a coupling section coupled to the liquid container 2 be tightly sealed, wherein the inkjet head (not illustrated in the drawings) is supplied with the inks from the ink tanks 4. The inkjet head is connected to the liquid supply ports of the ink containers 3 via connectors to be supplied with the inks from the ink containers 3. The ink container 2 applicable to the ink supply unit 1 may range in different types of containers, including an ink container 2A; a closed ink bottle illustrated in FIG. 4, an ink container 2B; an aluminum foil bag (liquid-filled bag, ink-filled bag) illustrated in FIG. 5, and an ink container 2C; release-type (ink-replenishable type) ink bottle illustrated in FIG. 6. The ink containers 2 have caps 3, described later, be fitted thereto, and the inks are supplied into the ink tanks 4 through the caps 3. The ink containers 2 applied to the ink supply unit 1 may be selected from any conventional ink bottles or aluminum foil bags in so far as the caps 3 are fittable thereto. The manner of fitting the cap 3 to the ink container 2 may be suitably changed depending on the type of the used container 2.

Specifically, the ink supply unit 1 according to this embodiment includes ink containers 2, caps 3, ink tanks 4, pivotable levers 5, anti-rotation mechanisms 6, conversion mechanisms 7, and valve-opening projections 8, as illustrated in FIGS. 7 to 12.

The ink supply unit 1 according to this embodiment is equipped with a plurality of sets of these components correspondingly to the number of printable colors, wherein each set consists of an ink container 2, a cap 3, an ink tank 4, a pivotable lever 5, an anti-rotation mechanism 6, a conversion mechanism 7, and a valve-opening projection 8. As illustrated in FIG. 7, the ink supply unit 1 described herein has eight sets, i.e., eight ink supply systems. The ink supply unit 1 has a cabinet 9, which is a box-shaped housing case, having an opening on its vertically upper side. As illustrated in FIGS. 7 and 8, the ink supply unit 1 has eight ink tanks 4 housed in the cabinet 9. The eight ink containers 2, correspondingly to the ink tanks 4, are loaded in the openings on the vertically upper side of the cabinet 9. The ink tube T extends from a side surface of the cabinet 9. A description is hereinafter given to one of the eight sets, unless stated otherwise. The vertical direction of this ink supply unit 1 is coincident with a direction of insertion of the ink container 2 and the cap 3 into the ink tank 4.

The cap 3 having an opening 33 constitutes a liquid supply port of the ink container 2. The pivotable lever 5 and the anti-rotation mechanism 6 constitute the connector described earlier. The connector is interposed between the liquid supply port and the inkjet head. The connector has a pivotable lever 5 and an anti-rotation mechanism 6. The pivotable lever 5 is a rotary member disposed on one end side of a liquid supply system having the inkjet head installed on the other end side thereof. The rotary member is independently rotatable and has a recess formed in the liquid supply port and engaging a projection, or a projection formed in the liquid supply port and engaging a recess. The anti-rotation mechanism 6 is a stopper that stops rotation of the ink container. The liquid supply system described herein refers to a liquid (ink or cleaning liquid) supply passage including the ink tube T. Rotation of the ink container 2 is stopped by the anti-rotation mechanism 6, and linear motion of the ink container 2 is effected by recess-projection relative movements in conjunction with the rotation of the pivotable lever 5. Then, the closed ink supply port (cap 3) is opened by the linear motion to supply the ink.

Specifically, the ink container 2 is a container that stores therein an ink. The ink container 2 may be any one of a closed ink bottle, an aluminum foil bag, or a release-type ink bottle. Unless stated otherwise, the ink container 2 hereinafter described is a closed ink bottle 2A (see FIG. 4) except for descriptions of FIGS. 16, 17, and 18. The ink container 2 described herein has a substantially cylindrical shape. The ink container 2 has one end part being closed and the other end part forming an ink flow-out opening 2*a* (see FIGS. 9 and 10) through which the ink flows out.

The cap 3 is fitted to the ink container 2. The cap 3 is a member in the form of a lid to be fitted to the ink flow-out opening 2*a* of the ink container 2. The cap 3 described herein is specifically a cylindrical screw cap.

More specifically, as illustrated in FIGS. 9 and 10, the cap 3 has an inner cylinder member 31 and an outer cylinder member 32 each having a cylindrical shape, an opening 33, a valve body 34, and an elastic body 35.

The inner cylinder member 31 has a cylinder portion 31*a*, a threaded groove 31*b*, a toroidal plate-like portion 31*c*, a valve body hole 31*d*, and a cylindrical spring holder 31*e*, all of which are integrally formed. The cylinder portion 31*a* has a cylindrical shape. The cylinder portion 31*a* has a plurality of stepped parts 31*f* and 31*g* in the form of a toroidal plate. The threaded groove 31*b* is formed in a spiral shape on the inner-peripheral surface side at one end part of the cylinder portion 31*a*. The toroidal plate-like portion 31*c* is formed in the shape of a toroidal plate on the inner-peripheral surface side at the other end part of the cylinder portion 31*a*. The cylinder portion 31*a* reduces in diameter by stages, at the stepped part 31*g*, and then at the stepped part 31*g*, in a direction from the threaded groove 31*b* toward the toroidal plate-like portion 31*c*. The valve body hole 31*d* is a circular hole formed in the toroidal plate-like portion 31*c*. The cylindrical spring holder 31*e* is formed in a cylindrical shape on the inner-peripheral surface side of the cylinder portion 31*a*. One end part of the cylindrical spring holder 31*e* is connected to the toroidal plate-like portion 31*c*. The cylindrical spring holder 31*e* extends from the toroidal plate-like portion 31*c* toward the threaded groove 31*b*. Of end parts of the cylindrical spring holder 31*e*, an end part nearer to the toroidal plate-like portion 31*c* communicates with the valve body hole 31*d*, and the other end part nearer to the threaded groove 31*b* is closed. The cylinder portion 31*a*, the toroidal plate-like portion 31*c*, the valve body hole 31*d*, and the cylindrical spring holder 31*e* are formed to be substantially coaxial.

The outer cylinder member 32 is mounted to the outer-peripheral surface side of the cylinder portion 31*a* of the inner cylinder member 31. The outer cylinder member 32 has a cylinder portion 32*a*, a toroidal plate-like portion 32*b*, and a toroidal plate-like portion 32*c*, all of which are integrally formed. The cylinder portion 32*a* has a cylindrical shape. The toroidal plate-like portion 32*b*, being mounted to one end part of the cylinder portion 32*a*, i.e., the inner cylinder member 31, is provided in the form of a toroidal plate on the outer-peripheral surface side at an end part nearer to the threaded groove 31*b*. The toroidal plate-like portion 32*c* having the shape of a toroidal plate, being mounted to the other end part of the cylinder portion 32*a*, i.e., the inner cylinder member 31, is formed on the inner-peripheral surface side at an end part nearer to the toroidal plate-like portion 31*c*.

The opening 33 allows the ink stored in the ink container 2 to flow out therethrough. The opening 33 is a circular hole formed in the toroidal plate-like portion 31*c*. The opening 33 is smaller in diameter than the valve body hole 31*d*. The opening 33, the cylinder portion 32*a* of the outer cylinder member 32, the toroidal plate-like portion 32*b*, and the toroidal plate-like portion 32*c* are formed to be substantially coaxial.

The valve body 34 allows the opening 33 to open and close. The valve body 34 described herein is a spherical body (ball). The valve body 34 has an outer diameter smaller than the diameter of the valve body hole 31*d* and greater than the diameter of the opening 33.

The elastic body 35 biases the valve body 34 from the inner side of the ink container 2 toward the closing position. The elastic body 35 described herein is a helical compression spring.

The elastic body 35 of the cap 3 is held by the cylindrical spring holder 31*e* of the inner cylinder member 31, and the valve body 34 of the cap 3 is located at a position nearer to the valve body hole 31*d* of the elastic body 35. With the cap 3 being thus positioned, the outer cylinder member 32 is mounted to the inner cylinder member 31 from the direction of the toroidal plate-like portion 31*c*. In the cap 3 having the outer cylinder member 32 be mounted to the inner cylinder member 31, the stepped part 31*g* and the toroidal plate-like portion 32*b* are in contact against each other, while the toroidal plate-like portion 31*c* and the toroidal plate-like portion 32*c* are oppositely disposed with a predetermined interval therebetween. With the outer cylinder member 32 of the cap 3 being mounted to the inner cylinder member 31 thereof, the outer-peripheral surface of the cylinder portion 31*a* nearer to the toroidal plate-like portion 31*c* and the inner-peripheral surface of the cylinder portion 32*a* are in contact against each other. In the cap 3, the outer cylinder member 32 is mounted to the inner cylinder member 31, and the elastic body 35 and the valve body 34 are held. Then, the outer cylinder member 32 is secured to the inner cylinder member 31 with machine screws into an integral unit. With the inner cylinder member 31 and the outer cylinder member 32 being integrally joined, the threaded groove 31*b* is threaded into the threaded groove 2*b* of the ink container 2. As a result, the cap 3 is fitted to the ink container 2. The threaded groove 2*b* of the ink container 2 is formed on the outer-peripheral surface side in a projecting part of the ink container 2 where the ink flow-out opening 2*a* is formed. In the cap 3 thus having the inner cylinder member 31 and the outer cylinder member 32 be integrally joined, the valve body 34 is pressed by the energizing force of the elastic body 35 toward the opening 33, specifically, pressed from the inner side of the ink container 2 toward the closing position.

With the cap 3 being fitted to the ink container 2, a toroidal sealing member 36 is interposed between the stepped part 31*f* and an end part of the ink container 2 where the ink flow-out opening 2*a* is formed. The sealing member 36, after the cap 3 is fitted to the ink container 2, serves to seal any gap between the stepped part 31*f* and the end part where the ink flow-out opening 2*a* is formed, thereby preventing leakage of the ink. The cap 3 is further provided with a toroidal O-ring 37 at a position along the outer periphery of the opening 33 between the toroidal plate-like portion 31*c* and the toroidal plate-like portion 32*c*. The O-ring 37 serves to seal any gap between the valve body 34 and the opening 33 when the valve body 34 is closed, thereby preventing leakage of the ink. Furthermore, a toroidal O-ring 38, as a sealing member, is fitted to the outer-peripheral surface of the stepped part 31*g* of the cap 3. The O-ring 38 seals any gap between the cap 3 and an ink storage space wall surface 41*a* described later after the ink container 2 and the cap 3 are coupled to and securely held in the ink tank 4, thereby preventing leakage of the ink. This will be further described later.

As illustrated in FIGS. 8, 9, and 10, the ink tank 4 holds the ink container 2 fitted with the cap 3 at a cap 3-side part of the ink container 2. The ink tank 4 is housed in the cabinet 9 as described earlier. The ink tank 4 has an ink storage space 41 for storage of the ink supplied from the ink container 2. The ink storage space wall surface 41*a* described earlier is a cylindrical wall surface that defines the ink storage space 41. The ink storage space 41 thereby defined has the shape of a circular cylinder. The cap 3-side part of the ink container 2 is held in the ink storage space 41 via the pivotable lever 5 described later. The ink tank 4 has a coupling section coupled to the ink container 2 be tightly sealed to store therein the ink supplied from the ink container 2. More specifically, the ink container 2 is coupled to the ink tank 4 via the cap 3 and the pivotable lever 5 described later. The coupling section of the ink tank 4 coupled to the ink container 2 is sealed with the O-ring 38. With the ink container 2 and the cap 3 being connected to and held in the ink tank 4, the O-ring 38 seals any gap between the cap 3 and the ink storage space wall surface 41*a* that defines the ink storage space 41 of the ink tank 4 to tightly seal the coupling section of the ink tank 4 coupled to the ink container 2. The ink tank 4 has a float-type sensor 14 (see FIG. 8) that detects the liquid level of the ink stored in the ink storage space 41 for management of residual ink based on the ink liquid level detected by the float-type sensor 14.

The ink supply unit 1 further has an open-to-atmosphere tube 10 communicating inside of the ink tank 4 with the atmosphere (see FIGS. 7, 9, 10, and 11). Specifically, the ink tank 4 according to this embodiment has an opening 45 that communicates inside of the liquid tank 4 with outside and opens toward the atmosphere, and the opening 45 has an open-to-atmosphere tube 10 that communicates inside of the ink tank 4 with the atmosphere as illustrated in FIG. 11. The opening 45 is formed on the vertically upper side of the ink tank 4. The open-to-atmosphere tube 10 may include a rubber tube, for example. With the ink container 2 being coupled to the ink tank 4, the open-to-atmosphere tube 10 communicates inside of the ink tank 4, i.e., the ink storage space 41, with outside, opening the inside of the ink storage space 41 to the atmosphere. The ink supply unit 1 further has an openable and closable lid member 11 (see FIGS. 7 and 8) that covers the ink storage space 41 to prevent the ink from flying out at the time of removal of the ink container 2 from the ink tank 4 (see FIGS. 7 and 8).

As illustrated in FIGS. 9, 10, 11, and 12, the pivotable lever 5 is disposed on the ink tank 4 so as to freely pivot on a pivoting center that is a pivot axis X. The pivotable lever 5 has a cylindrical portion 51 and a lever portion 52, which are integrally formed. The cylindrical portion 51 has a cylindrical shape. The cylindrical portion 51 is pivotably supported by the ink tank 4. The cap 3 and the ink container 2 are inserted in the cylindrical portion 51 on its inner-peripheral surface side. The cylindrical portion 51 is supported by a toroidal guiding groove 42 formed in the ink storage space wall surface 41*a*. The toroidal guiding groove 42 is formed in depth in the ink storage space wall surface 41*a*. The toroidal guiding groove 42 has a toroidal shape in a vertical view. The lever portion 52 is a bar-shaped portion radially projecting from the cylindrical portion 51. The lever portion 52 is exposed out of the cabinet 9 through a notch 43 formed in the ink tank 4 (see also FIG. 13) and a notch 9*a* formed in the cabinet 9. The cylindrical portion 51 has an arc-shaped notch 53 formed at a position radially (direction intersecting with the pivot axis X) facing the lever portion 52. The cylindrical portion 51 of the pivotable lever 5 is supported by the toroidal guiding groove 42 so that the pivot axis X is positioned along the vertical direction. The lever portion 52 thus arranged, when manually pivoted, is pivotable around the pivot axis X. The vertically upper end side of the cylindrical portion 51 of the pivotable lever 5 is positioned with machine screws 54 (see FIG. 11) to be pivotable in the toroidal guiding groove 42 of the ink tank 4 and to be prevented from falling off the toroidal guiding groove 42. The notches 43 and 9*a* are formed at positions and in dimensions appropriate for deterring the pivoting motion of the pivotable lever 5 from interfering with the movement of the lever portion 52.

As illustrated in FIGS. 9, 10, 11, 12, and 13, the anti-rotation mechanism 6 restricts relative rotations of the ink container 2 and of the cap 3 to the ink tank 4, with the ink container 2 fitted with the cap 3 being coupled to and held in the ink tank 4 at the cap 3-side part of the container. The anti-rotation mechanism 6 has an anti-rotation projection 61 and an anti-rotation engaging portion 62. The anti-rotation projection 61 has a plate-like shape radially projecting from the cap 3 or the ink container 2. The anti-rotation projection 61 described herein is formed at an end part of the cylinder portion 31*a* of the cap 3 nearer to the threaded groove 31*b*. Instead, the anti-rotation projection 61 may be formed at a part of the cylinder portion 31*a* nearer to the ink container 2. The anti-rotation engaging portion 62 is formed in the ink tank 4 and engageable with the anti-rotation projection 61. The anti-rotation engaging portion 62 is formed on a wall surface 44 on the radially outer side of the toroidal guiding groove 42 and on the vertically upper end side of the ink tank 4. The wall surface 44 is a cylindrical wall surface. The anti-rotation engaging portion 62 is a grooved portion formed on the wall surface 44. In this example, two circumferentially opposing ribs constitute the anti-rotation engaging portion 62. The anti-rotation engaging portion 62, with the ink tank 4 being set in the cabinet 9, extends to the toroidal guiding groove 42 along the insertion direction of the cap 3, i.e., the vertical direction. The anti-rotation projection 61 is formed in a dimension long enough to reach the anti-rotation engaging portion 62 through the notch 53 of the pivotable lever 5 after the cap 3 and the ink container 2 are inserted in the cylindrical portion 51 of the pivotable lever 5. To mount the ink container 2 and the cap 3 in the cylindrical portion 51 of the pivotable lever 5, the anti-rotation projection 61 of the anti-rotation mechanism 6 is inserted in the anti-rotation engaging portion 62 from the vertically upper side. The anti-rotation projection 61 of the anti-rotation mechanism 6 is engaged with the anti-rotation engaging portion 62, with the ink container 2 being held in the ink tank 4. This may restrict relative rotations of the ink container 2 and of the cap 3 to the ink tank 4 around the pivot axis X.

As illustrated in FIGS. 11, 12, 13, and 14, the conversion mechanism 7 converts the pivoting motion of the pivotable lever 5 into linear motions of the ink container 2 and of the cap 3 in a direction along the pivot axis X. The conversion mechanism 7 has guiding projections 71 and guiding recesses 72, which are respectively examples of the projection and the recess. The guiding projection 71 is a columnar portion radially projecting from the cap 3. The guiding projections 71 are formed in a pair on the outer-peripheral surface of the cylinder portion 31*a* of the cap 3. The guiding projections 71 are formed in a pair at substantially symmetrical positions along the outer-peripheral surface of the cylinder portion 31*a*. The anti-rotation projection 61 is located at a middle position between the paired guiding projections 71 along the outer-peripheral surface of the cylinder portion 31*a*. The guiding recesses 72 are formed in the cylindrical portion 51 of the pivotable lever 5. The guiding recess 72 described herein is a through hole penetrating through the wall surface of the cylindrical portion 51. Optionally, the guiding recess 72 may be a hole not penetrating through the wall surface of the cylindrical portion 51. The guiding recesses 72 are inclined relative to the direction along the pivot axis X. The guiding recesses 72 are formed in a pair correspondingly to the paired guiding projections 71. In the guiding recesses 72 are respectively inserted the corresponding guiding projections 71. More specifically, with the pivotable lever 5 being set on the ink tank 4, the guiding recesses 72 are inclined by degrees counterclockwise around the pivot axis X, from the vertically upper side toward the vertically lower side, as illustrated in FIG. 12. The guiding recesses 72 each have a vertically upper end that opens on the vertically upper end side of the cylindrical portion 51. On the other hand, vertically lower ends of these recesses are shaped substantially along the horizontal direction. To insert the ink container 2 and the cap 3 in the cylindrical portion 51 of the pivotable lever 5, the paired guiding projections 71 of the conversion mechanism 7 are inserted in openings on the vertically upper end sides of the guiding recesses 72. With the guiding projections 71 of the conversion mechanism 7 being inserted in the guiding recesses 72 thereof, the guiding recesses 72 guide the guiding projections 71 in the direction along the pivot axis X in conjunction with relative rotations of the pivotable lever 5 and of the cap 3. The conversion mechanism 7, with relative rotations of the ink container 2 and of the cap 3 being restricted, may convert the pivoting motion of the pivotable lever 5 into linear motions of the ink container 2 and of the cap 3 in the direction along the pivot axis X. To put it differently, the pivoting motion of the pivotable lever 5 may prompt the conversion mechanism 7 to move the ink container 2 and the cap 3 in the direction along the pivot axis X. The direction along the pivot axis X typically refers to the vertical direction. This direction described herein corresponds to a direction in which the ink container 2 and the cap 3 move toward and away from the ink tank 4, i.e., a direction in which the ink container 2 and the cap 3 are inserted in the ink tank 4.

The anti-rotation projection 61 of the cap 3, the paired guiding projections 71, the anti-rotation projection 62 on the wall surface 44 of the ink tank 4, and the paired guiding recesses 72 of the pivotable lever 5 have a positional relationship in which the paired guiding projections 71 are respectively insertable in the paired guiding recesses 72 and the anti-rotation projection 61 is insertable in the anti-rotation engaging portion 62, after the pivotable lever 5 is set on the ink tank 4, and the cap 3 and the ink container 2 are inserted in the cylindrical portion 51 of the pivotable lever 5.

As illustrated in FIGS. 9 and 10, a valve-opening projection 8 is formed inside the ink tank 4, i.e., the ink storage space 41. The valve-opening projection 8 is formed vertically on an ink storage space bottom surface 41*b* that defines the ink storage space 41. The valve-opening projection 8 is formed at a position vertically opposite to the opening 33 of the cap 3, after the pivotable lever 5 is disposed on the ink tank 4, and the cap 3 and the ink container 2 are inserted in the cylindrical portion 51 of the pivotable lever 5. The valve-opening projection 8 presses the valve body 34 toward an opening position when the cap 3 is drawn nearer to the ink tank 4 by the linear motions of the ink container 2 and of the cap 3.

As described earlier, the ink supply unit 1 includes the open-to-atmosphere tube 10 that communicates the ink storage space 41 of the ink tank 4 with outside, opening inside of the ink storage space 41 to the atmosphere. As illustrated in FIGS. 7 and 13, the open-to-atmosphere tube 10 is guided by a tube standing plate 12 from the ink tank 4 to the vertically upper side of the ink container 2, and then travels again on the outer-peripheral surface side of the wall surface 44 nearer to the ink tank 4. The open-to-atmosphere tube 10 extends to the vertically upper side of the ink container 2 to at least prevent the ink in the ink tank 4 from flowing out, with the ink container 2 being coupled to the ink tank 4. That is to say, the open-to-atmosphere tube 10 has a largest height in the vertical direction greater than the largest height of the ink container 2 applicable to the ink supply unit 1. As illustrated in FIGS. 13 and 14, the ink supply unit 1 according to this embodiment further includes an open-to-atmosphere projection 13 allowed to press the open-to-atmosphere tube 10 in conjunction with the pivoting motion of the pivotable lever 5. The open-to-atmosphere projection 13 is formed on the pivotable lever 5. The open-to-atmosphere projection 13 is formed so as to project from the outer-peripheral surface of the cylindrical portion 51. The open-to-atmosphere projection 13 is adjacent to one end part of the notch 53. The open-to-atmosphere projection 13 is allowed to move to and from a releasing position and a constricting position. The open-to-atmosphere tube 10 is released at the releasing position and is pressed to be constricted at the constricting position in conjunction with the pivoting motion of the pivotable lever 5. As illustrated in FIG. 13, the open-to-atmosphere projection 13 is located at the constricting position at which the open-to-atmosphere tube 10 is pressed to be constricted at least when the lever portion 52 of the pivotable lever 5 is located on the rightmost side in the notch 43 on the drawing of FIG. 13. As illustrated in FIG. 14, the open-to-atmosphere projection 13 is located at the releasing position at which the open-to-atmosphere tube 10 is released when the lever portion 52 of the pivotable lever 5 is located in the notch 43 on the leftmost side on the drawing of FIG. 14. As described below, the open-to-atmosphere projection 13 is located at the releasing position when the cap 3 is open, i.e., when the valve body 34 is at the opening position, and is located at the constricting position when the cap 3 is closed, i.e., when the valve body 34 is at the closing position.

The operation of the ink supply unit 1 is hereinafter described referring to FIG. 15. The structural elements of the ink supply unit 1 are described referring to FIGS. 9, 12, 13, 14, and 15. A pivoting direction of the pivotable lever 5 defined in the description below is a direction viewed from the vertically upper side.

In the ink supply unit 1, before the ink tank 4 starts to be replenished with the ink, the ink container 2 fitted with the cap 3 is inserted in the cylindrical portion 51 of the pivotable lever 5 from the direction of the cap 3 (setting starts), as illustrated on the left row of FIG. 15. The middle row of FIG. 15 illustrates the completion of setting of the ink container 2, at which time the pivotable lever 5 is yet to be pivoted (setting completed, pre-pivoting state). At this point, the pivotable lever 5 is situated as illustrated in FIG. 13. Specifically, the paired guiding projections 71 of the cap 3 are located in the openings on the vertically upper sides of the paired guiding recesses 72, and the lever portion 52 of the pivotable lever 5 is located in the notch 43 on the rightmost side on the drawing of FIG. 13. At this point, the ink container 2 is still unfixed and removable from the ink tank 4, and the valve body 34 is located at the closing position. In the ink tank 4, there is still a gap between the ink storage space wall surface 41*a* and the O-ring 38 fitted to the cap 3, and the gap has not been tightly sealed yet. Moreover, the open-to-atmosphere projection 13 is located at the constricting position at which the open-to-atmosphere tube 10 is pressed to be constricted. The open-to-atmosphere projection 13 located at this position is blocking the ink storage space 41 from communicating with the atmosphere through the open-to-atmosphere tube 10. The ink supply unit 1 in the described condition is not ready to supply the ink from the ink container 2 into the ink tank 4.

In the setting-completed ink supply unit 1, the pivotable lever 5, currently in the pre-pivoting state, starts to be pivoted clockwise (fixing direction) as illustrated in FIG. 13. Then, the cap 3 and the ink container 2 move in the direction along the pivot axis X, with the sealing performance by the O-ring 38 remaining effective. The movement here is directed toward the vertically lower side. Specifically, the cap 3 and the ink container 2 move along the pivot axis X toward the valve-opening projection 8 formed on the ink storage space bottom surface 41*b* of the ink tank 4. In further detail, the pivotable lever 5 is pivoted in the fixing direction, with relative rotations of the ink container 2 and of the cap 3 being restricted by the anti-rotation mechanism 6. Then, the guiding recesses 72 press the guiding projections 71 toward the vertically lower side in conjunction with the pivoting motion of the pivotable lever 5. Then, the cap 3 with the guiding projections 71 formed thereon and the ink container 2 integral with the cap 3, with their rotations being restricted, move toward the vertically lower side, i.e., toward the valve-opening projection 8.

As illustrated in FIG. 14, the pivotable lever 5 is pivoted until the lever portion 52 arrives at a position in the notch 43 on the leftmost side on the drawing of FIG. 14 to guide the guiding projections 71 to the horizontal parts at the vertically lower ends of the guiding recesses 72. In the ink supply unit 1 thus arranged, the ink container 2 is fixed to the ink tank 4 via the cap 3 and the pivotable lever 5, as illustrated on the right row of FIG. 15 (fixing completed). Then, the valve-opening projection 8 pushes the valve body 34 upward to the opening position against the energizing force of the elastic body 35, releasing the sealing performance by the O-ring 37. In the ink tank 4, at this point, any gap between the cap 3 and the ink storage space wall surface 41*a* is tightly sealed with the O-ring 38. Moreover, the open-to-atmosphere projection 13 is located at the releasing position at which the open-to-atmosphere tube 10 is released. The open-to-atmosphere projection 13 located at this position allows the ink storage space 41 to communicate with the atmosphere through the open-to-atmosphere tube 10. As a result, the ink in the ink container 2 is supplied into the ink storage space 41 of the ink tank 4 through the gap between the valve body 34 and the opening 33 (supply starts) even when the coupling section of the ink tank 4 coupled to the ink container 2 is tightly sealed with the O-ring 38. At this point, the stepped part 41*c* formed in the shape of a toroidal plate on the ink storage space wall surface 41*a* and the toroidal plate-like portion 31*c* of the cap 3 are vertically in contact against each other.

To remove the ink container 2 from the ink tank 4, the pivotable lever 5 is pivoted in a direction reverse to the before-mentioned direction. In the ink supply unit 1, with the ink container 2 being fixed in the ink tank 4, the pivotable lever 5 is pivoted counterclockwise (releasing direction), as illustrated in FIG. 14, to move the cap 3 and the ink container 2 in the direction along the pivot axis X. The movement here is directed toward the vertically upper side. As a result, the cap 3 and the ink container 2 move along the pivot axis X away from the valve-opening projection 8. In further detail, the pivotable lever 5 is pivoted in the releasing direction, with relative rotations of the ink container 2 and of the cap 3 being restricted by the anti-rotation mechanism 6, and the guiding recesses 72 press the guiding projections 71 toward the vertically upper side in conjunction with the pivoting motion of the pivotable lever 5. Then, the cap 3 with the guiding projections 71 formed thereon and the ink container 2 integral with the cap 3, with their rotations being restricted, move toward the vertically upper side, i.e., away from the valve-opening projection 8. Accordingly, the valve-opening projection 8 no longer presses the valve body 34, and the valve body 34 is pushed back to the closing position by the energizing force of the elastic body 35. As a result, the sealing performance by the O-ring 37 is resumed to stop the ink supply through the gap between the valve body 34 and the opening 33. As illustrated in FIG. 13, the pivotable lever 5 is pivoted until the lever portion 52 arrives at a position in the notch 43 on the rightmost side on the drawing of FIG. 13, allowing the ink container 2 and the cap 3 to be removed from the ink tank 4. At this point, the open-to-atmosphere projection 13 is located at the constricting position at which the open-to-atmosphere tube 10 is pressed to be constricted as described earlier referring to FIG. 13. The open-to-atmosphere projection 13 located at this position is blocking the ink storage space 41 from communicating with the atmosphere through the open-to-atmosphere tube 10. This may prevent the ink remaining in the open-to-atmosphere tube 10 from flowing out into the ink tank 4 at the time of removal of the ink container 2 and the cap 3 from the ink tank 4.

By moving the lever portion 52 in the fixing direction, the ink container 2 is fixed in the ink tank 4, the open-to-atmosphere tube 10 is opened (open-to-atmosphere projection 13 is released), and the ink supply starts through the gap defined by a degree of contact between the valve body 34 and the valve-opening projection 8. Thus, the ink supply unit 1 may be capable of achieving the three functions by simply manipulating the lever portion 52 once. By moving the lever portion 52 in the releasing direction, the ink container 3 is removed from the ink tank 4, the open-to-atmosphere tube 10 is closed (by the open-to-atmosphere projection 13), and the valve body 34 and the open-to-atmosphere projection 8 move away from each other to close the gap, stopping the ink supply. Thus, the ink supply unit 1 may be capable of achieving the three functions by simply manipulating the lever portion 52 once. This ink supply unit 1 may advantageously improve handleability at the time of insertion and removal of the ink container 2 and also suppress users' operational variability.

In the ink supply unit 1 and the inkjet printers 100A, 100B, and 100C thus characterized, the cap 3 and the ink container 2 are inserted in the pivotable lever 5, and the pivotable lever 5 is pivoted with the rotations of the ink container 2 and of the cap 3 being restricted by the anti-rotation mechanism 6. The pivoting motion of the pivotable lever 5 is converted by the conversion mechanism 7 into linear motions of the ink container 2 and of the cap 3, and the cap 3 is drawn nearer to the ink tank 4 by the linear motions to have the valve body 34 of the cap 3 be opened by the valve-opening projection 8. Resultantly, the ink tank 4 may be replenished with the ink from the ink container 2. In the ink supply unit 1, pivoting the pivotable lever 5 in the reverse direction moves the ink container 2 and the cap 3 away from the ink tank 4 to close the valve body 34 of the cap 3, stopping the ink replenishment for the ink tank 4. The ink supply unit 1 thus configured and operated may successfully improve workability of ink replenishment for the ink tank 4.

The ink supply unit 1 is, for example, operable to set the ink container 2 in the ink tank 4 as described and pivot the pivotable lever 5 to initiate and complete ink replenishment. This may allow the ink supply from the ink container 2 into the ink tank 4 to be successfully completed while regulating relative rotations of the ink container 2 and of the cap 3. The ink supply unit 1 may effectively prevent the cap 3 from accidentally loosening, thereby reducing the likelihood of ink leakage during the ink replenishment. This may ensure safety of the ink supply from the ink container 2 into the ink tank 4. Further advantageously, insertion and removal of the ink container 2 in and out of the ink tank 4 may be safely and mechanically enabled by simply pivoting the pivotable lever 5. This may lessen users' operational variability, affording improved workability for users.

Further advantageously, the open-to-atmosphere tube 10 may be constricted or released by the open-to-atmosphere projection 13 in conjunction with the pivoting motion of the pivotable lever 5 at the time of inserting and removing the ink container 2 in and out of the ink tank 4. The ink supply unit 1 may resultantly perform adequate ink replenishment by reliably opening the ink tank 4 to the atmosphere. This may allow the residual ink of the ink tank 4 to be properly managed based on the detection result of the float-type sensor 14. Further advantageously, the ink remaining in the open-to-atmosphere tube 10 may be reliably prevented from flowing out into the ink tank 4 at the time of removal of the ink container 2.

In the ink supply unit 1 according to this embodiment, the open-to-atmosphere tube 10 extends to the vertically upper side of the ink container 2 to prevent at least the ink of the ink tank 4 from flowing out, with the ink container 2 being held in the ink tank 4. This may allow variously different ink containers 2 to be applicable to the ink supply unit 1, providing for improved versatility.

Referring to FIGS. 16, 17, and 18 are described changes of the liquid levels of the inks in different types of ink containers 2.

FIG. 16 illustrates changes of the ink liquid level when the ink container 2A, a closed ink bottle, is used in the ink supply unit 1. In the ink supply unit 1, while the ink is being supplied from the ink container 2A into the ink tank 4, the ink storage space 41 is allowed to communicate with the atmosphere through the open-to-atmosphere tube 10. When the ink of the ink container 2A, a closed ink bottle, is supplied into the ink tank 4, the liquid level of the ink lowers by degrees, being replaced with the atmosphere introduced into the ink container 2A through the open-to-atmosphere tube 10 and the ink storage space 41. The ink container 2A, a closed ink bottle, is essentially a rigid body. Therefore, the ink container 2 is not deflated under the atmospheric pressure. When such a closed ink bottle is used as the ink container 2A, the atmosphere gradually replaces the ink in the ink container 2A during the ink supply from the ink container 2A into the ink tank 4. This causes the ink to flow out of the ink container 2A into the ink tank 4, lowering by degrees the liquid level of the ink in the ink container 2A. Once the ink is pooled in the ink storage space 41 up to the level near an edge of the cap 3 (vertical direction) and the ink storage space 41 is filled with the ink to its full capacity, the ink-atmosphere replacement in the ink container 2A temporarily stops. Every time when the ink in the ink storage space 41 thereafter decreases, the ink flows out of the ink container 2A into the ink tank 4. The ink container 2A having a required rigidity is not collapsible under the atmospheric pressure. Therefore, it may not be necessary to extend the open-to-atmosphere tube 10 to the vertically upper side of the ink container 2A. The ink may be prevented from flowing out through the opening of the open-to-atmosphere tube 10 in so far as the open-to-atmosphere tube 10 extends to a slightly higher level than the ink tank 4. In the illustrated ink supply unit 1, the open-to-atmosphere tube 10 extends to the vertically upper side of the ink container 2 applicable to the ink supply unit 1 to improve versatility, allowing the other ink containers 2B and 2C to be applicable as well.

FIG. 17 illustrates changes of the ink liquid level when the ink container 2B, an aluminum foil bag, is used in the ink supply unit 1. The ink container 2B, an aluminum foil bag, is deflated by degrees under the atmospheric pressure as the ink continues to be supplied into the ink tank 4. For a degree of deflation of the ink container 2B, an aluminum foil bag, caused by the atmospheric pressure, the ink of the ink storage space 41 flows toward the open-to-atmosphere tube 10. The ink flowing toward the open-to-atmosphere tube 10 is subject to the atmospheric pressure from the direction of the open-to-atmosphere tube 10 as well, and the atmospheric pressures from these directions are finally counterbalanced. As a result, the ink liquid level in the ink container 2B and the ink liquid level in the open-to-atmosphere tube 10 become substantially equal. In this ink supply unit 1, the ink liquid level in the open-to-atmosphere tube 10 at its peak stays equal to or below the ink liquid level in the ink container 2B. Extending the open-to-atmosphere tube 10 to the vertically upper side of the ink container 2B, therefore, may prevent the ink from flowing out through the opening of the open-to-atmosphere tube 10. Thus, outflow of the ink from the open-to-atmosphere tube 10 may be successfully avoided. Every time when the ink in the ink storage space 41 decreases, the ink flows out of the ink container 2B into the ink tank 4. The ink liquid level in the ink container 2B and the ink liquid level in the open-to-atmosphere tube 10, therefore, fall to lower levels almost synchronously.

FIG. 18 illustrates changes of the ink liquid level when the ink container 2C, a release-type (ink-replenishable type) ink bottle, is used in the ink supply unit 1. The ink container 2C, a release-type ink bottle, has a required rigidity. Therefore, changes of the ink liquid level in the ink container 2C are substantially the same as in the ink container 2B, an aluminum foil bag, except that the ink container 2C is not deflated under the atmospheric pressure. As the ink is further supplied into the ink tank 4, the ink liquid level falls by degrees in the ink container 2C, a release-type ink bottle, opening to the atmosphere. The ink flowing out of the ink storage space 41 toward the open-to-atmosphere tube 10 due to the atmospheric pressure is subject to the atmospheric pressure from the direction of the open-to-atmosphere tube 10 as well, and the atmospheric pressures from these directions are finally counterbalanced. As a result, the ink liquid level in the ink container 2C and the ink liquid level in the open-to-atmosphere tube 10 become substantially equal. In this ink supply unit 1, the ink liquid level in the open-to-atmosphere tube 10 at its peak stays equal to or below the ink liquid level in the ink container 2C, as with the ink container 2B, an aluminum foil bag. Extending the open-to-atmosphere tube 10 to the vertically upper side of the ink container 2C, therefore, may prevent the ink from flowing out through the opening of the open-to-atmosphere tube 10. Thus, outflow of the ink from the open-to-atmosphere tube 10 may be successfully avoided. Every time when the ink in the ink storage space 41 decreases, the ink flows out of the ink container 2B into the ink tank 4. The ink liquid level in the ink container 2C and the ink liquid level in the open-to-atmosphere tube 10, therefore, fall to lower levels almost synchronously. The ink container 2C, a release-type ink bottle, may be fitted with a lid to close its opening for ink replenishment unless the ink replenishment is necessary. The lid, however, does not tightly seal the opening, resulting in substantially the same effect.

With the ink container 2 being coupled to the ink tank 4, the open-to-atmosphere tube 10 extends at least to the vertically upper side of the ink container 2. The ink supply unit 1 thus structured is improved in versatility and thereby usable with various types of ink containers 2. This is an advantageous feature for manufacturing cost reduction.

For stability of ink supply in the inkjet printers 100A, 100B, and 100C each, the internal pressure of the ink tank 4 needs to stay within a certain range of pressures. Otherwise, a pressure difference between inside and outside of the ink tank 4 may be off-balanced. This may be detrimental to smooth ink supply, compromising a degree of precision in the control of an ink discharge quantity. On this count, the inkjet printers 100A, 100B, and 100C each, by equipping the ink tank 4 with the opening 45 and the open-to-atmosphere tube 10, may prevent the internal pressure of the ink tank 4 from overly elevating or dropping. In this regard, providing the open-to-atmosphere tube 10 in the ink tank 4 is actually not an indispensable requirement in the ink-replenishable ink container 2C opening to the atmosphere. However, this embodiment characterized as described so far may allow the ink supply unit 1 to be available with various types of ink containers 2, making it unnecessary to prepare any ink tank 4 and ink supply unit 1 for exclusive use with the tightly sealed ink container 2A, deformable ink container 2B such as an aluminum foil bag, or a release-type ink container 2C. As a result, an unnecessary increase of facility costs may be suppressible.

According to the inkjet printers 100A, 100B, and 100C of the embodiments described earlier, an inkjet printing apparatus includes: a liquid storage container (ink container 2) for storage of a liquid (ink); and a liquid tank (ink tank 4) disposed on the vertically lower side of the liquid storage container to store therein the liquid supplied from the liquid storage container, the liquid tank having a coupling section coupled to the liquid storage container be tightly sealed, the inkjet printing apparatus being structured to supply an inkjet head with the liquid stored in the liquid tank, wherein the liquid tank has an opening 45 that communicates inside of the liquid tank with outside and opens toward the atmosphere, the opening 45 has an open-to-atmosphere tube 10 that communicates inside of the ink tank with the atmosphere, and the open-to-atmosphere tube 10 extends to the vertically upper side of the liquid storage container coupled to the liquid tank to at least prevent the liquid in the liquid tank from flowing out. In the ink supply unit 1, the coupling section of the ink tank 4 coupled to the ink container 2 is tightly sealed, the liquid storage container (ink container 2) is coupled to the liquid tank (ink tank 4), and the open-to-atmosphere tube 10 extends at least to the vertically upper side of the ink container 2. These structural features may successfully prevent outflow of the liquid from the open-to-atmosphere tube 10 whichever of variously different liquid storage containers 2 is applied to the ink supply unit 1. Thus, the ink supply unit 1 improved in versatility may be advantageously provided.

The inkjet printing apparatus according to the aforementioned embodiments of the present invention may not necessarily be configured as thus far described, and may be variously modified within the scope of the appended claims.

Although it has so far been described that the recesses (guiding recesses 72) are formed at positions nearer to the rotary member (pivotable lever 5), and the projections (guiding projections 71) are formed at positions nearer to the ink supply port (cap 3), the positions of the recesses and projections may be reversed. It has so far been described that the guiding recess 72 is an example of the recess, and the guiding projection 71 is an example of the projection. Instead, the recess and projection may be an external threaded groove and an internal threaded groove threaded into each other.

In the description thus far given, an ink is stored, as an example of the liquid, in the liquid storage container and the liquid tank and supplied to the inkjet head. The liquid stored and supplied to the inkjet head may be a cleaning liquid.

The inkjet printing apparatus described earlier may include: a cap fittable to the ink container, the cap having an opening that allows the ink stored in the ink container to flow out therethrough, a valve body that allows the opening to open and close, and an elastic body that biases the valve body from an inner side of the ink container toward a closing position; a pivotable lever disposed on the ink tank pivotably around a pivot axis that is a pivoting center; an anti-rotation mechanism configured to restrict relative rotations of the ink container and of the cap to the ink tank, with the cap-fitted ink container being held in the ink tank at a cap-side part thereof; a conversion mechanism configured to convert the pivoting motion of the pivotable lever into linear motions of the ink container and of the cap in a direction along the pivot axis; a valve-opening projection disposed inside of the ink tank, the valve-opening projection serving to press the valve body toward an opening position when the cap is drawn nearer to the ink tank by the linear motions of the ink container and of the cap; and a sealing member that tightly seals a gap between the cap and a wall surface that defines an ink storage space in the ink tank, with the ink container and the cap being held in the ink tank, to tightly seal the coupling section of the ink tank coupled to the ink container.

The invention claimed is:

1. An ink supply unit, comprising:

an ink container for storage of an ink;

a cap finable to the ink container, the cap having an opening that allows the ink stored in the ink container to flow out therethrough, a valve body that allows the opening to open and close, and an elastic body that biases the valve body from an inner side of the ink container toward a closing position;

an ink tank structured to hold the ink container fitted with the cap at a cap-side part of the ink container;

a pivotable lever disposed on the ink tank pivotably around a pivot axis that is a pivoting center;

an anti-rotation mechanism configured to restrict relative rotations of the ink container and of the cap to the ink tank with the ink container being held in the ink tank;

a conversion mechanism configured to convert a pivoting motion of the pivotable lever into linear motions of the ink container and of the cap in a direction along the pivot axis; and a valve-opening projection disposed inside of the ink tank, the valve-opening projection serving to press the valve body toward an opening position when the cap is drawn nearer to the ink tank by the linear motions of the ink container and of the cap;

wherein the conversion mechanism is formed between the pivotable lever and the cap;

the pivotable lever is formed in cylindrical shape and is supported by the ink tank, and the pivotable lever is pivoted in a state in which the linear motions in the direction along the pivot axis being restricted;

the cap is formed in cylindrical shape and is inserted so as to be in contact with an inner-peripheral surface side of the pivotable lever formed in cylindrical shape;

the cap is restricted from the pivoting motion with the pivotable lever around the pivot axis as the pivoting center by the anti-rotation mechanism when the pivotable lever is pivoted, and the cap is performed with the linear motions in the direction along the pivot axis relative to the pivotable lever.

2. The ink supply unit according to claim 1, wherein the pivotable lever has a cylindrical shape and is pivotably supported by the ink tank, the pivotable lever including a cylindrical portion formed in a cylindrical shape and having the cap be inserted therein, and a lever portion radially projecting from the cylindrical portion, the conversion mechanism includes a guiding projection radially projecting from the cap and a guiding recess formed in a wall surface of the cylindrical portion, the guiding recess being inclined relative to the direction along the pivot axis and having the guiding projection be inserted therein, and the guiding recess guides the guiding projection in the direction along the pivot axis in conjunction with relative rotations of the pivotable lever and of the cap.

3. The ink supply unit according to claim 2, further comprising:

an open-to-atmosphere tube that communicates inside of the ink tank with the atmosphere, with the ink container being held in the ink tank; and an open-to-atmosphere projection disposed on the pivotable lever and movable to and from a releasing position and a constricting position, the releasing position and the constricting position respectively being positions at which the open-to-atmosphere tube is released and the open-to-atmosphere tube is pressed to be constricted in conjunction with the pivoting motion of the pivotable lever, wherein the open-to-atmosphere projection is located at the releasing position when the valve body is at the opening position, and the open-to-atmosphere projection is located at the constricting position when the valve body is at the closing position.

4. The ink supply unit according to claim 1, wherein the anti-rotation mechanism includes: an anti-rotation projection radially projecting from the ink container or the cap formed in a cylindrical shape; and an anti-rotation engaging portion formed in the ink tank and engageable with the anti-rotation projection.

5. The ink supply unit according to claim 4, further comprising:

an open-to-atmosphere tube that communicates inside of the ink tank with the atmosphere, with the ink container being held in the ink tank; and an open-to-atmosphere projection disposed on the pivotable lever and movable to and from a releasing position and a constricting position, the releasing position and the constricting position respectively being positions at which the open-to-atmosphere tube is released and the open-to-atmosphere tube is pressed to be constricted in conjunction with the pivoting motion of the pivotable lever, wherein the open-to-atmosphere projection is located at the releasing position when the valve body is at the opening position, and the open-to-atmosphere projection is located at the constricting position when the valve body is at the closing position.

6. The ink supply unit according to claim 1, further comprising:

an open-to-atmosphere tube that communicates inside of the ink tank with the atmosphere, with the ink container being held in the ink tank; and an open-to-atmosphere projection disposed on the pivotable lever and movable to and from a releasing position and a constricting position, the releasing position and the constricting position respectively being positions at which the open-to-atmosphere tube is released and the open-to-atmosphere tube is pressed to be constricted in conjunction with the pivoting motion of the pivotable lever, wherein the open-to-atmosphere projection is located at the releasing position when the valve body is at the opening position, and the open-to-atmosphere projection is located at the constricting position when the valve body is at the closing position.

* * * * *